US011932511B2

(12) United States Patent
Iioka

(10) Patent No.: US 11,932,511 B2
(45) Date of Patent: Mar. 19, 2024

(54) MEDIUM FEEDING MECHANISM

(71) Applicant: RISO KAGAKU CORPORATION, Tokyo (JP)

(72) Inventor: Yuzuru Iioka, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 188 days.

(21) Appl. No.: 17/557,587

(22) Filed: Dec. 21, 2021

(65) Prior Publication Data

US 2022/0234853 A1 Jul. 28, 2022

(30) Foreign Application Priority Data

Jan. 22, 2021 (JP) ..... 2021-008833
Sep. 30, 2021 (JP) ..... 2021-160677

(51) Int. Cl.

| | |
|---|---|
| ***B65H 7/02*** | (2006.01) |
| ***B65H 1/04*** | (2006.01) |
| ***B65H 3/08*** | (2006.01) |
| ***B65H 5/26*** | (2006.01) |
| ***B65H 7/16*** | (2006.01) |
| ***B65H 7/18*** | (2006.01) |
| *B65H 3/12* | (2006.01) |

(52) U.S. Cl.

CPC ..... *B65H 7/02* (2013.01); *B65H 1/04* (2013.01); *B65H 3/08* (2013.01); *B65H 5/26* (2013.01); *B65H 7/16* (2013.01); *B65H 7/18* (2013.01); *B65H 3/128* (2013.01)

(58) Field of Classification Search

CPC ... B65H 3/08; B65H 5/26; B65H 7/02; B65H 7/04; B65H 7/16; B65H 7/18; B65H 7/20; B65H 2513/10; B65H 2513/50; B65H 2513/512

See application file for complete search history.

(56) References Cited

U.S. PATENT DOCUMENTS

| | | | | |
|---|---|---|---|---|
| 2009/0057984 A1* | 3/2009 | Matsumoto | ..... | B65H 7/02 271/10.09 |
| 2015/0021846 A1* | 1/2015 | Lee | ..... | B65H 3/06 271/229 |
| 2015/0368056 A1* | 12/2015 | Murata | ..... | B65H 1/04 271/259 |

FOREIGN PATENT DOCUMENTS

JP 2004-051347 2/2004

* cited by examiner

*Primary Examiner* — Prasad V Gokhale
(74) *Attorney, Agent, or Firm* — Greenblum & Bernstein, P.L.C.

(57) ABSTRACT

A medium feeding mechanism includes: a feeder that feeds a medium; a transport path that is coupled to the feeder; a transporter that transports the medium through the transport path; a transport drive that drives the transporter; an entry detection sensor that detects when the medium fed from the feeder has entered the transport path; a take-in transporter that takes in the medium transported by the transporter; and a transport controller that controls the feeder and the take-in transporter, wherein when the entry detection sensor detects entry of the medium at a time that falls within a first range set in advance, the controller controls the take-in transporter so as to take in the medium, and when the entry detection sensor detects entry of the medium at a time that falls within a second range following the first range.

9 Claims, 16 Drawing Sheets

<DIAGRAM DEPICTING RELATIONSHIP BETWEEN TRANSPORT VELOCITY AND ELAPSED TIME SO AS TO ILLUSTRATE CORRECTION OF TRANSPORT VELOCITY IN ONE EMBODIMENT (EXAMPLE 1)>

FIG. 12A

| | THEORETICAL PASSAGE TIME | REQUIRED TIME | PERMISSIBLE PASSAGE TIME | | ACTUAL PASSAGE TIME | EXPECTED PASSAGE TIME | PERMISSIBLE JAM TIME |
|---|---|---|---|---|---|---|---|
| | | | (EARLY) | (LATE) | | | |
| FIRST ENTRANCE PASSAGE DETECTION SENSOR | 100 | | 80 | 120 | | | 380 |
| FIRST MIDSTREAM PASSAGE DETECTION SENSOR 1 | 150 | 50 | 135 | 165 | | | 435 |
| FIRST MIDSTREAM PASSAGE DETECTION SENSOR 2 | 200 | 100 | 190 | 210 | | | 490 |
| FIRST MIDSTREAM PASSAGE DETECTION SENSOR 3 | 250 | 150 | 245 | 255 | | | 545 |
| FIRST EXIT PASSAGE DETECTION SENSOR | 300 | 200 | 300 | 300 | | | 600 |
| PAPER STOP SENSOR | 350 | 250 | 350 | 350 | | | 650 |

FIG. 12B

| | THEORETICAL PASSAGE TIME | REQUIRED TIME | PERMISSIBLE PASSAGE TIME | | ACTUAL PASSAGE TIME | EXPECTED PASSAGE TIME | PERMISSIBLE JAM TIME |
|---|---|---|---|---|---|---|---|
| | | | (EARLY) | (LATE) | | | |
| FIRST ENTRANCE PASSAGE DETECTION SENSOR | 100 | | 80 | 120 | 140 | | 380 |
| FIRST MIDSTREAM PASSAGE DETECTION SENSOR 1 | 150 | 50 | 135 | 165 | | 190 | 435 |
| FIRST MIDSTREAM PASSAGE DETECTION SENSOR 2 | 200 | 100 | 190 | 210 | | 240 | 490 |
| FIRST MIDSTREAM PASSAGE DETECTION SENSOR 3 | 250 | 150 | 245 | 255 | | 290 | 545 |
| FIRST EXIT PASSAGE DETECTION SENSOR | 300 | 200 | 300 | 300 | | 340 | 600 |
| PAPER STOP SENSOR | 350 | 250 | 350 | 350 | | 390 | 650 |

FIG. 12C

| | THEORETICAL PASSAGE TIME | REQUIRED TIME | PERMISSIBLE PASSAGE TIME | | ACTUAL PASSAGE TIME | EXPECTED PASSAGE TIME | PERMISSIBLE JAM TIME |
|---|---|---|---|---|---|---|---|
| | | | (EARLY) | (LATE) | | | |
| FIRST ENTRANCE PASSAGE DETECTION SENSOR | 100 | | 80 | (140) | 140 | (140) | / |
| FIRST MIDSTREAM PASSAGE DETECTION SENSOR 1 | 150 | 50 | 135 | 210 | | 190 | / |
| FIRST MIDSTREAM PASSAGE DETECTION SENSOR 2 | 200 | 100 | 190 | 255 | | 240 | / |
| FIRST MIDSTREAM PASSAGE DETECTION SENSOR 3 | 250 | 150 | 245 | 300 | | 290 | / |
| FIRST EXIT PASSAGE DETECTION SENSOR | 300 | 200 | 300 | 345 | | 340 | / |
| PAPER STOP SENSOR | 350 | 250 | 350 | 395 | | / | / |

FIG. 12D

| | THEORETICAL PASSAGE TIME | REQUIRED TIME | PERMISSIBLE PASSAGE TIME | | ACTUAL PASSAGE TIME | EXPECTED PASSAGE TIME | PERMISSIBLE JAM TIME |
|---|---|---|---|---|---|---|---|
| | | | (EARLY) | (LATE) | | | |
| FIRST ENTRANCE PASSAGE DETECTION SENSOR | 100 | | 80 | (140) | 140 | (140) | 740 |
| FIRST MIDSTREAM PASSAGE DETECTION SENSOR 1 | 150 | 50 | 135 | 210 | | 190 | 795 |
| FIRST MIDSTREAM PASSAGE DETECTION SENSOR 2 | 200 | 100 | 190 | 255 | | 240 | 850 |
| FIRST MIDSTREAM PASSAGE DETECTION SENSOR 3 | 250 | 150 | 245 | 300 | | 290 | 905 |
| FIRST EXIT PASSAGE DETECTION SENSOR | 300 | 200 | 300 | 345 | | 340 | 960 |
| PAPER STOP SENSOR | 350 | 250 | 350 | 395 | | 390 | 1010 |

| | THEORETICAL PASSAGE TIME | REQUIRED TIME | PERMISSIBLE PASSAGE TIME | | ACTUAL PASSAGE TIME | EXPECTED PASSAGE TIME | PERMISSIBLE JAM TIME |
|---|---|---|---|---|---|---|---|
| | | | (EARLY) | (LATE) | | | |
| FIRST ENTRANCE PASSAGE DETECTION SENSOR | 100 | | 80 | (140) | 140 | (140) | 740 |
| FIRST MIDSTREAM PASSAGE DETECTION SENSOR 1 | 150 | 50 | 135 | 210 | | 190 | 795 |
| FIRST MIDSTREAM PASSAGE DETECTION SENSOR 2 | 200 | 100 | 190 | 255 | | 240 | 850 |
| FIRST MIDSTREAM PASSAGE DETECTION SENSOR 3 | 250 | 150 | 245 | 300 | | 290 | 905 |
| FIRST EXIT PASSAGE DETECTION SENSOR | 300 | 200 | 300 | 345 | | 340 | 960 |
| PAPER STOP SENSOR | 350 | 250 | 350 | 710 | | 705 | 1010 |

FIG. 15

MEDIUM FEEDING MECHANISM

CROSS-REFERENCE TO RELATED APPLICATION

This application is based upon and claims the benefit of priority of the prior Japanese Patent Application No. 2021-008833, filed on Jan. 22, 2021 and the prior Japanese Patent Application No. 2021-160677 filed on Sep. 30, 2021, the entire contents of which are incorporated herein by reference.

FIELD

The embodiments discussed herein are related to a medium feeding mechanism.

BACKGROUND

In a proposed conventional paper feeding apparatus for an image formation apparatus, when a detection switch determines that a non-paper-feed jam has occurred, a drive control unit performs control such that a paper feeding roller stops rotating, a sheet is returned into a sheet accommodation part by means of a return roller, and then the paper feeding roller starts to rotate again (see, for example, Japanese Laid-open Patent Publication No. 2004-51347).

SUMMARY

In an aspect, a medium feeding mechanism includes: a feeder that feeds a medium; a transport path that is coupled to the feeder; a transporter that transports the medium through the transport path; a transport drive that drives the transporter; an entry detection sensor that detects when the medium fed from the feeder has entered the transport path; a take-in transporter that takes in the medium transported by the transporter; and a controller that controls the feeder and the take-in transporter, wherein when the entry detection sensor detects entry of the medium at a time that falls within a first range set in advance, the controller controls the take-in transporter so as to take in the medium, and when the entry detection sensor detects entry of the medium at a time that falls within a second range following the first range, the controller controls the feeder so as to delay feeding of a medium to be transported next, and controls the take-in transporter so as to delay a take-in time for the medium.

The object and advantages of the present invention will be realized by the elements set forth in the claims or combinations thereof.

BRIEF DESCRIPTION OF DRAWINGS

FIG. 12A is a table for illustrating the rescheduling of permissible times for sensors in one embodiment (example 1);

FIG. 12B is a table for illustrating the rescheduling of permissible times for sensors in one embodiment (example 2);

FIG. 12C is a table for illustrating the rescheduling of permissible times for sensors in one embodiment (example 3);

FIG. 12D is a table for illustrating the rescheduling of permissible times for sensors in one embodiment (example 4);

FIG. 15 is a table for illustrating the rescheduling of permissible times for sensors in another embodiment.

DESCRIPTION OF EMBODIMENTS

Figure 1:
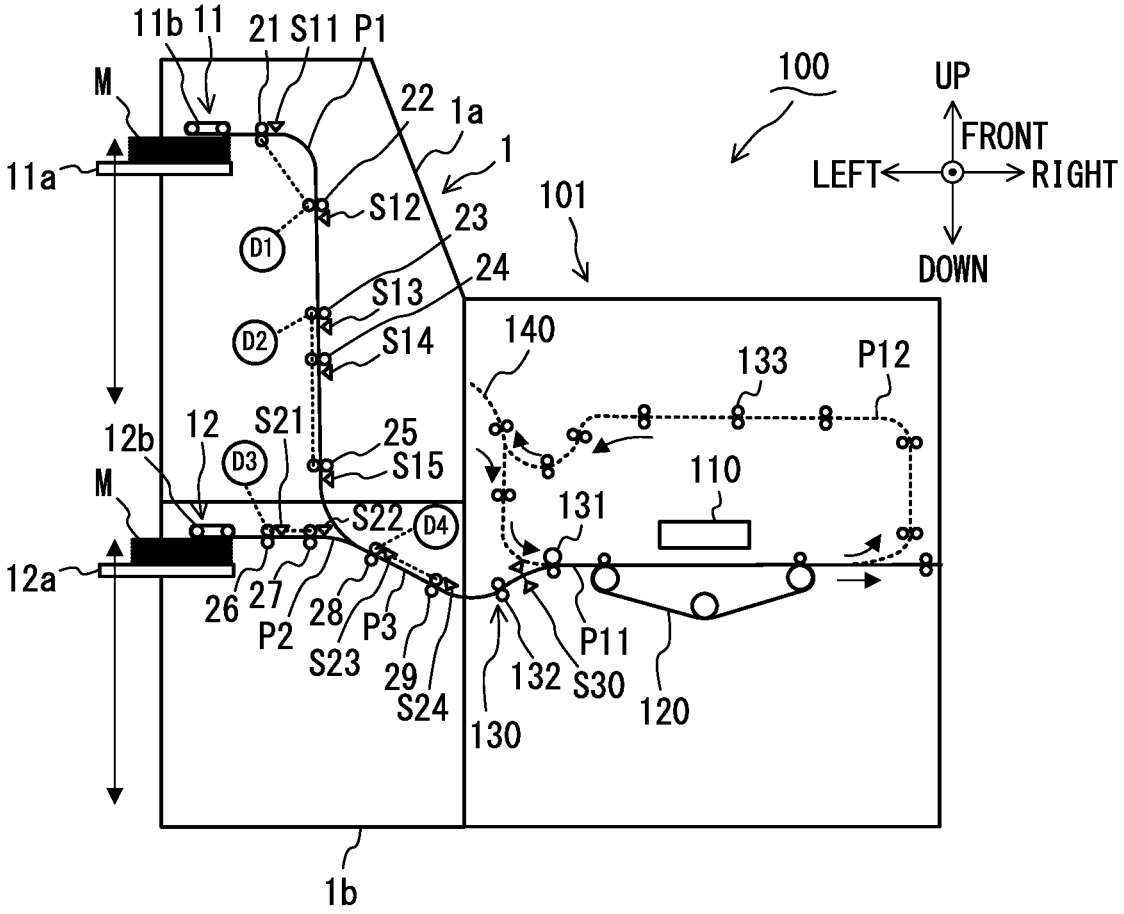
FIG. 1 illustrates the internal configuration of a printing system in one embodiment.

In the meantime, a medium feeder that blows out air to float a plurality of media placed on a placement mount, including an uppermost medium, and transports the floating uppermost medium by means of a transport belt may have a bad attraction state when causing a medium to be attracted to the transport belt; and when, for example, media are transported with a low attraction force, one attracted medium, although advancing to some degree, may not arrive, within a specified time, at an entrance passage detection sensor disposed at a transport path, and it may be determined that free spinning has occurred. It may also be determined like this that free spinning has occurred in other feeding techniques such as a feeding technique in which media are fed using a roller as described above.

In a case where it is determined that free spinning has occurred while a medium has been transported up to a position very close to the entrance passage detection sensor, even if the transport belt is stopped soon, the medium may be transported by some distance before the transport completely stops, and thus could arrive at a transport roller provided at the transport path before being stopped. In this case, the medium, which should have been stopped due to the determination that free spinning has occurred, continues to be transported.

When a medium is detected by the entrance passage detection sensor at a time that follows a reference passage time, the transport velocity may be increased such that media arrive at a take-in transporter such as a paper-stop-roller pair at more constant times.

However, when a medium is detected at a time that is far behind a reference passage time, the transport velocity will need to be increased accordingly, and a motor may be required to provide performance exceeding the upper limit. Even if transporting is performed with the upper limit of the permissible transport velocity of the motor, the transport velocity will be less than a transport velocity that would be required to compensate for the delay, so the time of passing a passage detection sensor positioned downstream in the transport direction from the entrance passage detection sensor will also be delayed, resulting in the determination that a jam has occurred. Moreover, the intervals between times at which media arrive at the take-in transporter cannot be made constant.

The following describes a medium feeding mechanism in accordance with one embodiment of the present invention and a medium feeding mechanism in accordance with another embodiment of the present invention by referring to the drawings.

One Embodiment

FIG. 1 illustrates the internal configuration of a printing system 100.

Figure 2:
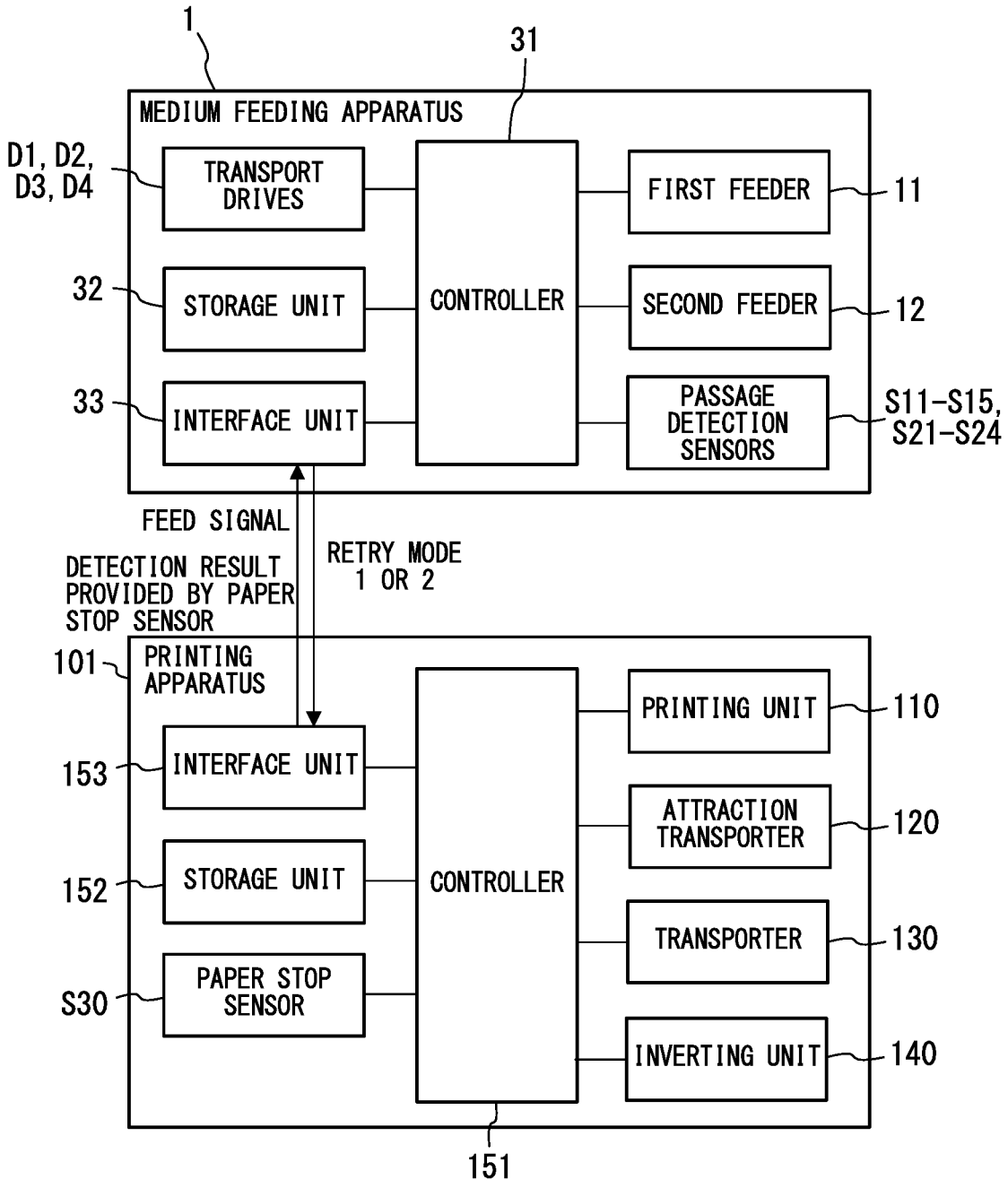
FIG. 2 illustrates the control configurations of a medium feeding apparatus and a printing apparatus in one embodiment.

FIG. 2 illustrates the control configurations of a medium feeding apparatus 1 and a printing apparatus 101.

Figure 3:
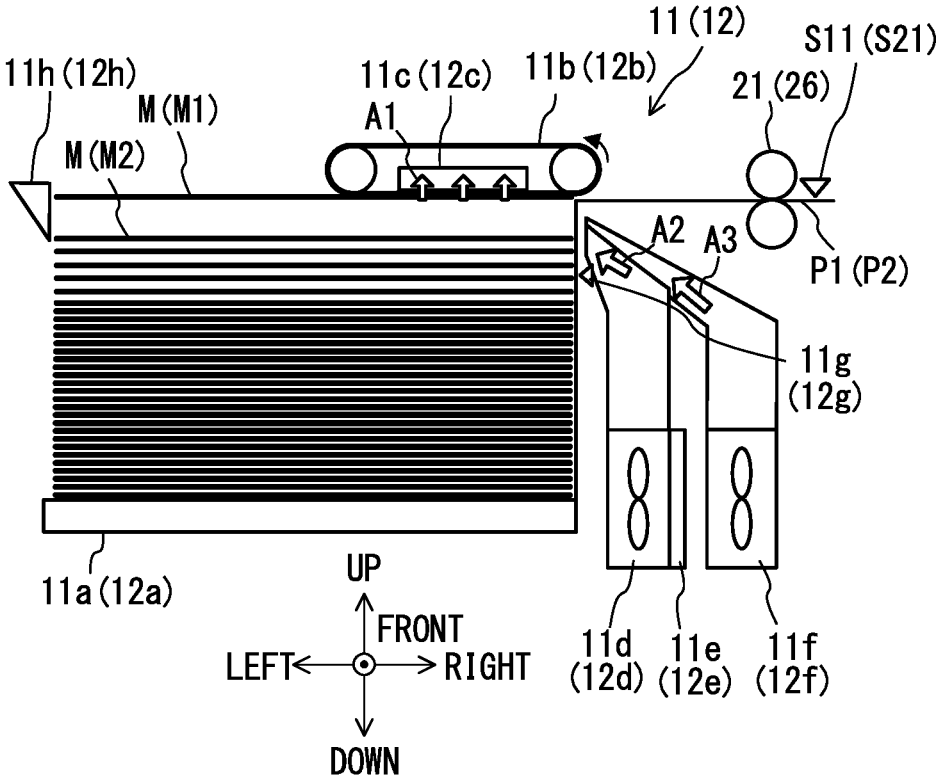
FIG. 3 illustrates the internal configuration of a first feeder (second feeder) in one embodiment.

FIG. 3 illustrates the internal configuration of a first feeder 11 (second feeder 12).

The front-rear direction, up-down direction, and left-right direction indicated in FIGS. 1 and 3 and FIGS. 10A and 10B (described hereinafter) are merely directions for descriptive purposes. For example, the front-rear direction and the left-right direction may each be a horizontal direction, and the up-down direction may be a vertical direction.

The printing system 100 depicted in FIG. 1 includes the medium feeding apparatus 1 and the printing apparatus 101. As will be described hereinafter in detail, the medium feeding mechanism in the present embodiment includes the medium feeding apparatus 1, components on a transport route extending to a paper-stop-roller pair 131 in the printing apparatus 101 (a reception roller pair 132, the paper-stop-roller pair 131, a paper stop sensor S30, and a joining transport path P3), and a controller 151 for the printing apparatus 101.

The medium feeding mechanism feeds a medium M toward the downstream side in the transport direction with reference to the paper-stop-roller pair 131 in the printing apparatus 101 (the downstream side is an example of a destination to which the medium M is fed). The destination apparatus for media M is not limited to the printing apparatus 101 and may be another apparatus such as a transport apparatus or a post-processing apparatus. The medium feeding apparatus 1 may be integral with a destination apparatus such as the printing apparatus 101. Media M are, for example, sheets (flat paper) but may be other sheet-like media such as films.

As depicted in FIG. 1, the medium feeding apparatus 1 includes a first feeder 11, a second feeder 12, a first individual transport path P1, a second individual transport path P2, a joining transport path P3, first to ninth transport roller pairs 21-29, first to fourth transport drives D1-D4, a first entrance passage detection sensor S11, first midstream passage detection sensors S12-S14, a first exit passage detection sensor S15, a second entrance passage detection sensor S21, second midstream passage detection sensors S22 and S23, and a second exit passage detection sensor S24. As depicted in FIG. 2, the medium feeding apparatus 1 also includes a controller 31, a storage unit 32, and an interface unit 33.

The medium feeding apparatus 1 is divided into an upper stage 1*a* and a lower stage 1*b*. The first feeder 11 is disposed in the upper stage 1*a*. The second feeder 12 is disposed in the lower stage 1*b*. Thus, the first feeder 11 and the second feeder 12 are vertically arranged. The first feeder 11 and the second feeder 12 are examples of a feeder that feeds a medium M. The feeders may each be constituted by a single feeder or three or more feeders.

As depicted in FIG. 3, the first feeder 11 and the second feeder 12 respectively include placement mounts 11*a* and 12*a*, transport belts 11*b* and 12*b*, suction units 11*c* and 12*c*, floating-air blowout mechanisms 11*d* and 12*d*, floating air shutters 11*e* and 12*e*, separation-air blowout mechanisms 11*f* and 12*f*, medium detection sensors 11*g* and 12*g*, and end fences 11*h* and 12*h*. The first feeder 11 and the second feeder 12 may have similar configurations, and in FIG. 3, reference symbols for the second feeder 12 are provided in parenthesis next to reference symbols for the first feeder 11. Similarly, in FIG. 3, reference symbols for the sixth transport roller pair 26 and the second entrance passage detection sensor S21 are provided in parenthesis next to reference symbols for the first transport roller pair 21 and the first entrance passage detection sensor S11.

A plurality of media M are placed on each of the placement mounts 11*a* and 12*a*. The placement mount 11*a* of the first feeder 11 and the placement mount 12*a* of the second feeder 12 may each have a different type (e.g., size, material, color) of media M placed thereon. In this case, when changing the type of media M on which printing is to be performed, the feeder for feeding the media M is switched between the first feeder 11 and the second feeder 12. The placement mounts 11*a* and 12*a* are lifted or lowered by being driven by a placement-mount lifting-and-lowering drive (not illustrated). As an example, when the number of media M placed on the placement mount 11*a*(12*a*) decreases, a controller (not illustrated) for the first feeder 11 (second feeder 12) (or the controller 31 depicted in FIG. 2) may control the placement-mount lifting-and-lowering drive so as to lift the placement mount 11*a*(12*a*) on the basis of the amount of reflection of light emitted by the medium detection sensor 11*g*(12*g*) (described hereinafter) in the horizontal direction at a predetermined placement-surface height.

For example, the transport belt 11*b*(12*b*) may be shaped like a looped strip and cover two pulleys. The transport belt 11*b*(12*b*) includes a plurality of through holes through which suction air A1 sucked by the suction unit 11*c*(12*c*) (described hereinafter) passes. The transport belt 11*b*(12*b*) rotates counterclockwise with reference to FIG. 3, so as to draw out, one by one, media M attracted thereto by the suction unit 11*c*(12*c*) sucking suction air A1. The transport belt 11*b*(12*b*) is an example of a drawing-out unit that draws out media M one by one from the first feeder 11 (second feeder 12). Note that another transport member such as a transport roller may be replaced with the transport belt 11*b*(12*b*) so as to be used as the drawing-out unit.

The suction unit 11*c*(12*c*) sucks suction air A1 through the plurality of through holes provided through the transport belts 11*b* and 12*b* by being driven by a sucker (e.g., a suction fan) (not illustrated). In this way, the suction unit 11*c*(12*c*) causes a floating uppermost media M1, among a plurality of media M placed on the placement mount 11*a* (12*a*), to be attracted to the transport belt 11*b*(12*b*).

The floating-air blowout mechanism 11*d*(12*d*) floats at least the uppermost medium M1 of the plurality of media M placed on the placement mount 11*a*(12*a*) by blowing out floating air A2 by means of, for example, a blowout fan. The floating-air blowout mechanisms 11*d* and 12*d* may each blow out floating air A2 obliquely upward so as to float, for example, about 10 media M, including the uppermost medium M1. Although FIG. 3 depicts the floating-air blowout mechanisms 11*d* and 12*d* disposed on the downstream side in the direction in which media M are transported (disposed on the right side), floating-air blowout mechanisms may also be disposed on both sides of the media M in a width direction (front-rear direction) orthogonal to the direction in which the media M are transported.

The floating air shutter 11*e*(12*e*) is an example of a blocking part that blocks blowout of floating air A2 by the floating-air blowout mechanism 11*d*(12*d*), and is closed to be positioned at a close position where the floating air shutter blocks the blowout and is opened to be positioned at an open position at which the floating air shutter does not block the blowout. The blocking part may be a controller for stopping the blowout of floating air A2 by the floating-air blowout mechanism 11*d*(12*d*), and the blowout of floating air A2 can be immediately blocked using the floating air shutter 11*e*(12*e*). The floating air shutter 11*e*(12*e*) can be situated at one or more positions between the close position and the open position so that the quantity of floating air A2 can be adjusted.

The separation-air blowout mechanism 11*f*(12*f*) blows out separation air A3 by means of, for example, a blowout fan so as to separate the uppermost medium M1 from a second medium M2 located under the uppermost medium M1. As with the floating-air blowout mechanisms 11*d*(12*d*), the separation-air blowout mechanisms 11*f*(12*f*) may include a separation air shutter, i.e., an example of a blocking part, such that the entirety of or a portion of separation air A3 can be blocked. Although FIG. 3 depicts the separation-air blowout mechanisms 11*f* and 12*f* disposed on the downstream side in the direction in which media M are transported (disposed on the right side), separation-air blowout mechanisms may also be disposed on both sides of the media M in the width direction of the media M (front-rear direction).

The medium detection sensor 11*g*(12*g*) detects a medium M placed on the placement mount 11*a*(12*a*). For example, the medium detection sensor 11*g*(12*g*) may detect the presence/absence of a medium M at a detection height on the basis of reflected light resulting from detection light emitted in the horizontal direction. The medium detection sensor 11*g*(12*g*) detects the presence/absence of a medium M, thereby allowing a controller for the first feeder 11 (second feeder 12) (not illustrated) (or the controller 31 depicted in FIG. 2) to detect the height of the uppermost medium M1 placed on the placement mount 11*a*(12*a*). The medium detection sensor 11*g*(12*g*) may emit detection light toward floating media M and, on the basis of the quantity of resultant reflected light, detect the floating state of the media M (e.g., the number of media M falling within a detectable range in the height direction).

The end fence 11*h*(12*h*) restricts the position of the upstream-side edge portion of a floating medium M in the transport direction. Although not illustrated, a pair of side fences for restricting the positions of the edge portions, in the width direction, of media M placed on the placement mount 11*a*(12*a*) may also be disposed.

As described above, the first feeder 11 (second feeder 12) includes the floating-air blowout mechanism 11*d*(12*d*) and blows out floating air A2 to float a medium M, thereby feeding the medium M. However, the first feeder 11 and the second feeder 12 may also be feeders that feed a medium M without floating the same.

Although not illustrated, the first feeder 11 (second feeder 12) may include a placement-mount lifting-and-lowering drive such as a motor (an example of an actuator) for moving up or down the placement mount 11*a*(12*a*), and a drawing-out drive such as a motor (an example of an actuator) for rotating a drive pulley constituting one of the two pulleys covered by the transport belt 11*b*(12*b*).

Referring to FIG. 1 again, the first individual transport path P1 is coupled to the first feeder 11. The second individual transport path P2 is coupled to the second feeder 12. The joining transport path P3 joins the first individual transport path P1 and the second individual transport path P2 together and extends to the paper-stop-roller pair 131 in the printing apparatus 101. The first individual transport path P1 and the second individual transport path P2 are different in terms of the route lengths of the transport routes for a medium M. For example, the route length of the second individual transport path is half or less of that of the first individual transport path P1.

A large proportion of the first individual transport path P1 is disposed within the upper stage 1*a* of the medium feeding apparatus 1. The second individual transport path P2 is disposed within the lower stage 1*b* of the medium feeding apparatus 1. The first individual transport path P1 joins the second individual transport path P2 on a portion of the joining transport path P3 that is disposed within the lower stage 1*b*.

The first to ninth transport roller pairs 21-29 each include a driving roller and a driven roller that are disposed facing each other, and each transport a medium M in a nipping manner.

The first to fifth transport roller pairs 21-25 transport a medium M on the first individual transport path P1 within the upper stage 1*a* of the medium feeding apparatus 1. The sixth and seventh transport roller pairs 26 and 27 transport a medium M on the second individual transport path P2 within the lower stage 1*b* of the medium feeding apparatus 1. The eighth and ninth transport roller pairs 28 and 29 transport a medium M on a portion of the joining transport path P3 that is located within the lower stage 1*b* of the medium feeding apparatus 1. The reception roller pair 132 in the printing apparatus 101 (described hereinafter) transport a medium M on the portion of the joining transport path P3 that is located within the printing apparatus 101. The first to fifth transport roller pairs 21-25 and the sixth and seventh transport roller pairs 26 and 27 are examples of a plurality of individual transporters that transport a medium M on the first individual transport path P1 or the second individual transport path P2 (a plurality of individual transport paths). The eighth and ninth transport roller pairs 28 and 29 and the reception roller pair 132 are examples of a joining transporter that transports a medium M on the joining transport path P3. The first individual transport path P1, the second individual transport path P2, and the joining transport path P3 are examples of a transport path coupled to a feeder (first feeder 11 or second feeder 12). The first to ninth transport roller pairs 21-29 and the reception roller pair 132 are also examples of a transporter (first conveyor) that transports a medium M on a transport path.

The first to fourth transport drives D1-D4 are motors (examples of an actuator) for rotating the driving rollers of the first to ninth transport roller pairs 21-29. The first transport drive D1 rotates the driving rollers of the first and second transport roller pairs 21 and 22. The second transport drive D2 rotates the driving rollers of the third to fifth transport roller pairs 23-25. The third transport drive D3 rotates the driving rollers of the sixth and seventh transport roller pairs 26 and 27. The fourth transport driver D4 rotates the driving rollers of the eighth and ninth transport roller pairs 28 and 29. The first and second transport drives D1 and D2 and the third transport drive D3 are examples of individual transport drives for driving a plurality of individual transporters (first to seventh transport roller pairs 21-27). The fourth transport drive D4 and a transport drive (not illustrated) for driving the reception roller pair 132 are examples of joining transport drives for driving joining transporters (eighth and ninth transport roller pairs 28 and 29 and reception roller pair 132). The first to fourth transport drives D1-D4 and the transport drive (not illustrated) for driving the reception roller pair 132 are examples of transport drives for driving transporters (first to ninth transport roller pairs 21-29 and reception roller pair 132). For example, media M may be transported by the first to ninth transport roller pairs 21-29 at a constant transport velocity. However, the first individual transport path P1, the second individual transport path P2, and the joining transport path P3 may each attain a different transport velocity. Alternatively, the transport velocity of the inside of at least one of the first individual transport path P1, the second individual transport path P2, and the joining transport path P3 may be different from the transport velocity of the inside of the other paths.

For example, the first entrance passage detection sensor S11, the first midstream passage detection sensors S12-S14, the first exit passage detection sensor S15, the second entrance passage detection sensor S21, the second midstream passage detection sensors S22 and S23, and the second exit passage detection sensor S24 may be reflecting or transmitting photoelectric sensors that detect passage of a medium M.

The first entrance passage detection sensor S11 is disposed adjacent to the first transport roller pair 21 at a position downstream from the first transport roller pair 21 in the transport direction. The first midstream passage detection sensor S12 is disposed adjacent to the second transport roller pair 22 at a position downstream from the second transport roller pair 22 in the transport direction. The first midstream passage detection sensor S13 is disposed adjacent to the third transport roller pair 23 at a position downstream from the third transport roller pair 23 in the transport direction. The first midstream passage detection sensor S14 is disposed adjacent to the fourth transport roller pair 24 at a position downstream from the fourth transport roller pair 24 in the transport direction. The first exit passage detection sensor S15 is disposed adjacent to the fifth transport roller pair 25 at a position downstream from the fifth transport roller pair 25 in the transport direction.

It can be said that the first entrance passage detection sensor S11 detects passage of a medium M in the vicinity of the entrance to the first individual transport path P1 and that the first exit passage detection sensor S15 detects passage of a medium M in the vicinity of the exit from the first individual transport path P1.

The second entrance passage detection sensor S21 is disposed adjacent to the sixth transport roller pair 26 at a position downstream from the sixth transport roller pair 26 in the transport direction. The second midstream passage detection sensor S22 is disposed adjacent to the seventh transport roller pair 27 at a position downstream from the seventh transport roller pair 27 in the transport direction. The second midstream passage detection sensor S23 is disposed adjacent to the eighth transport roller pair 28 at a position downstream from the eighth transport roller pair 28 in the transport direction. The second exit passage detection sensor S24 is disposed adjacent to the ninth transport roller pair 29 at a position downstream from the ninth transport roller pair 29 in the transport direction.

It can be said that the second entrance passage detection sensor S21 detects passage of a medium M in the vicinity of the entrance to the second individual transport path P2, and that the second exit passage detection sensor S24 detects passage of a medium M at a portion of the joining transport path P3 in the vicinity of the exit of the medium feeding apparatus 1.

The first entrance passage detection sensor S11 and the second entrance passage detection sensor S21 are each an example of an entry detection sensor that detects when a medium M fed from a feeder (first feeder 11 or second feeder 12) has entered a transport path (first individual transport path P1 or second individual transport path P2). The entry detection sensor is not particularly limited in terms of the detection position at a transport path (first individual transport path P1 or second individual transport path P2), and thus may be the first midstream passage detection sensor S12 or the second midstream passage detection sensor S22. However, the entry detection sensor should be used to determine whether free spinning has occurred for a medium M, and is thus desirably disposed close to the first feeder 11 or the second feeder 12.

The first midstream passage detection sensors S12-S14, the first exit passage detection sensor S15, the second midstream passage detection sensors S22 and S23, the second exit passage detection sensor S24, and the paper stop sensor S30 are each an example of a passage detection sensor that detects passage of a medium M at a position downstream from an entry detection sensor (first entrance passage detection sensor S11 or second entrance passage detection sensor S21) in the transport direction of the medium M and upstream from a take-in transporter (paper-stop-roller pair 131) in the transport direction.

The controller 31 depicted in FIG. 2, which is an example of a transport controller, includes a processor (e.g., central processing unit (CPU)) for functioning as an arithmetic processing apparatus for controlling the operations of the entirety of the medium feeding apparatus 1 and controls the components of the medium feeding apparatus 1. For example, the controller 31 may control the first feeder 11, the second feeder 12, and the first to fourth transport drives D1-D4 on the basis of a feed signal for a medium M that is received by the interface unit 33 (described hereinafter) from the interface unit 153 (controller 151) of the printing apparatus 101. When a feed signal from the printing apparatus 101 is received by controllers disposed for the first feeder 11 and the second feeder 12, these controllers may control the first feeder 11 and the second feeder 12. When the medium feeding apparatus 1 is integral with a destination apparatus such as the printing apparatus 101, the controller of the destination apparatus (e.g., the control unit 151 of the printing apparatus 101 (described hereinafter)) may function as the controller 31.

For example, the storage unit 32 may include a memory such as a read only memory (ROM) consisting of a read-only semiconductor memory having a predetermined control program recorded therein in advance, or a random access memory (RAM) consisting of a randomly writable/readable semiconductor memory used as a working storage region on an as-needed basis when a processor executes various control programs. When the medium feeding apparatus 1 is integral with a destination apparatus such as the printing apparatus 101, the storage unit of the destination apparatus (e.g., the storage unit 152 of the printing apparatus 101 (described hereinafter)) may function as the storage unit 32.

The interface unit 33 communicates various information with external devices such as the printing apparatus 101. For example, the interface unit 33 may receive, from the interface unit 153 of the printing apparatus 101, information such as a feed signal for a medium M or a detection result provided by the paper stop sensor S30, and the controller 31 may control the operations of various components of the medium feeding apparatus 1 on the basis of the information. The interface unit 33 sends information such as a report pertaining to a retry mode 1 or 2 (described hereinafter) to the interface unit 153 of the printing apparatus 101.

Next, descriptions are given of the printing apparatus 101.

As depicted in FIGS. 1 and 2, the printing apparatus 101 includes a printing unit 110, an attraction transporter 120, a transporter 130, the paper stop sensor S30, a destination transport path P11, a circulation inverting transport path P12, an inverting unit 140, the controller 151, the storage unit 152, and the interface unit 153. Note that FIG. 1 depicts the joining transport path P3 and the destination transport path P11 by using a solid line and depicts the circulation inverting transport path P12 by using a dashed line.

For example, the printing unit 110 may include line-head-type inkjet heads (not illustrated) for various colors to be used in printing. The printing unit 110 may use a printing scheme other than the inkjet printing scheme.

As depicted in FIG. 1, the attraction transporter 120 is disposed facing the printing unit 110. The attraction transporter 120 transports a medium M by means of a transport belt while attracting the medium M.

The transporter 130 includes: the paper-stop-roller pair 131, which corrects skew of a medium M transported toward the printing unit 110 upon the medium M abutting the paper-stop-roller pair 131; the reception roller pair 132, which transports a medium M on the joining transport path P3 continuous from the medium feeding apparatus 1; and a plurality of transport roller pairs 133 that transport a medium Mon the destination transport path P11 or the circulation inverting transport path P12. The paper-stop-roller pair 131, the reception roller pair 132, and the plurality of transport roller pairs 133 transport a medium M in a nipping manner.

The paper-stop-roller pair 131 is an example of a take-in transporter (second conveyor) that takes media M transported by the above-described transporters (first to ninth transport roller pairs 21-29 and reception roller pair 132) onto, for example, the destination transport path P11 in the printing apparatus 101. The paper-stop-roller pair 131 is an example of a reference arrival position at the joining transport path P3. For example, media M may arrive at the paper-stop-roller pair 131 at reference arrival times having certain intervals therebetween. For example, media M may be taken in by the paper-stop-roller pair 131 at take-in times having certain intervals therebetween. A reference arrival time and a take-in time may be times with a duration. For each medium M, a reference arrival time and a take-in time may be set on the basis of, for example, a printing time of the printing unit 110 that corresponds to the size of the medium M or details of printing on the medium M, or the spaces between media M successively transported. The fact that a medium M arrives at the paper-stop-roller pair 131 after a reference arrival time can be used as information for deciding that a jam has occurred. When a medium M arrives at the paper-stop-roller pair 131 after a reference arrival time, the time at which the printing unit 110 starts printing will be delayed, or the accuracy in correction of skew will vary. Note that the reference arrival position may also be any position other than the paper-stop-roller pair 131.

The paper stop sensor S30 is disposed in the vicinity of the paper-stop-roller pair 131 at a portion of the joining transport path P3 upstream from the paper-stop-roller pair 131 in the transport direction. The paper stop sensor S30 is an example of an arrival detection sensor that is disposed at the joining transport path P3 and detects an arrival time of a medium M. The arrival detection sensor may also be the second exit passage detection sensor S24 disposed at the portion of the joining transport path P3 within the medium feeding apparatus 1. As described above, the medium feeding mechanism in the present embodiment includes the medium feeding apparatus 1, the components on the transport route extending to the paper-stop-roller pair 131 in the printing apparatus 101 (the reception roller pair 132, the paper-stop-roller pair 131, the paper stop sensor S10, and the joining transport path P3), and the controller 151 of the printing apparatus 101. Hence, the reception roller pair 132 and the paper stop sensor S30 can be said to be portions of the medium feeding mechanism.

The paper-stop-roller pair 131, i.e., an example of the reference arrival position, is not provided with a sensor for detecting a medium M. Accordingly, it can be determined whether a medium M has arrived at the paper stop sensor 131 on the basis of a detection result provided by the paper stop sensor S30.

The destination transport path P11 is coupled to the joining transport path P3 continuous from the medium feeding apparatus 1 and extends downstream in the transport direction with reference the paper-stop-roller pair 131. When the printing system 100 depicted in FIG. 1 has disposed therewithin another printing apparatus and a medium ejection apparatus positioned downstream in the transport direction from the printing apparatus 101, the destination transport path P11 will be coupled to the transport paths within these apparatuses.

A medium M with one surface having undergone printing by the printing unit 110 is transported to the circulation inverting transport path P12 so as to have the other surface thereof undergo printing.

The inverting unit 140 includes an inverting path for inverting the front and back sides of a medium M transported on the circulation inverting transport path R12, and a switchback roller pair.

The controller 151 depicted in FIG. 2 includes a processor (e.g., CPU) that functions as an arithmetic processing apparatus for controlling the operations of the entirety of the printing apparatus 101, and controls the components of the printing apparatus 101. As will be described hereinafter in detail, on the basis of a report pertaining to the retry mode 1 or 2 received from the controller 31 of the medium feeding apparatus 1, the controller 151 controls the paper-stop-roller pair 131 such that the take-in time for a medium M is delayed. Thus, it can be said that the controller 31 of the medium feeding apparatus 1 indirectly controls the paper-stop-roller pair 131 by using the controller 151 of the printing apparatus 101.

For example, the storage unit 152 may include a memory such as a ROM consisting of a read-only semiconductor memory having a predetermined control program recorded therein in advance, or a RAM consisting of a randomly writable/readable semiconductor memory used as a working storage region on an as-needed basis when a processor executes various control programs.

The interface unit 153 communicates various information with the medium feeding apparatus 1 and external devices such as user terminals that transmit print data. For example, as described above, the interface unit 153 may send information such as a feed signal for a medium M or a detection result provided by the paper stop sensor S30 to the interface unit 33 of the medium feeding apparatus 1, and receive information such as a report pertaining to the retry mode 1 or 2 from the interface unit 33.

The following describes an overview of operations of the printing system 100 while omitting, as appropriate, descriptions of matters that have already been given hereinbefore.

First, on the basis of a feed signal for media M received by the interface unit 33 from the printing apparatus 101 (interface unit 153), the controller 31 illustrated in FIG. 2 controls the first feeder 11 and the second feeder 12 such that the media M are fed while switching between the first feeder 11 and the second feeder 12 depicted in FIG. 1 or such that the media M are fed from only either of the first feeder 11 and the second feeder 12.

The controller 31 controls the first to fifth transport roller pairs 21-25 by using the first transport drive D1 and the second transport drive D2 so as to transport, on the first individual transport path P1, a medium M fed from the first feeder 11. Passage of the medium M being transported on the first individual transport path P1 is detected by the first entrance passage detection sensor S11, the first midstream passage detection sensors S12-S14, and the first exit passage detection sensor S15.

The controller 31 also controls the sixth and seventh transport roller pairs 26 and 27 by using the third transport drive D3 so as to transport, on the second individual transport path P2, a medium M fed from the second feeder 12. Passage of a medium M being transported on the second individual transport path P2 is detected by the second entrance passage detection sensor S21 and the second midstream passage detection sensor S22.

The control unit 31 also controls the eighth and ninth transport roller pairs 28 and 29 by using the fourth transport drive D4 so as to transport, on the joining transport path P3, a medium M transported from the first individual transport path P1 or the second individual transport path P2. Passage of a medium M being transported on the joining transport path P3 is detected by the second midstream passage detection sensor S23 and the second exit passage detection sensor S4.

Accordingly, a medium M is fed to the printing apparatus 101 by being transported on the joining transport path P3 continuous from the medium feeding apparatus 1, and the passage (arrival) of the medium M is detected by the paper stop sensor S30. Subsequently, the medium M abuts the paper-stop-roller pair 131 and thus has skew thereof corrected, and then undergoes printing by the printing unit 110.

Figure 4:
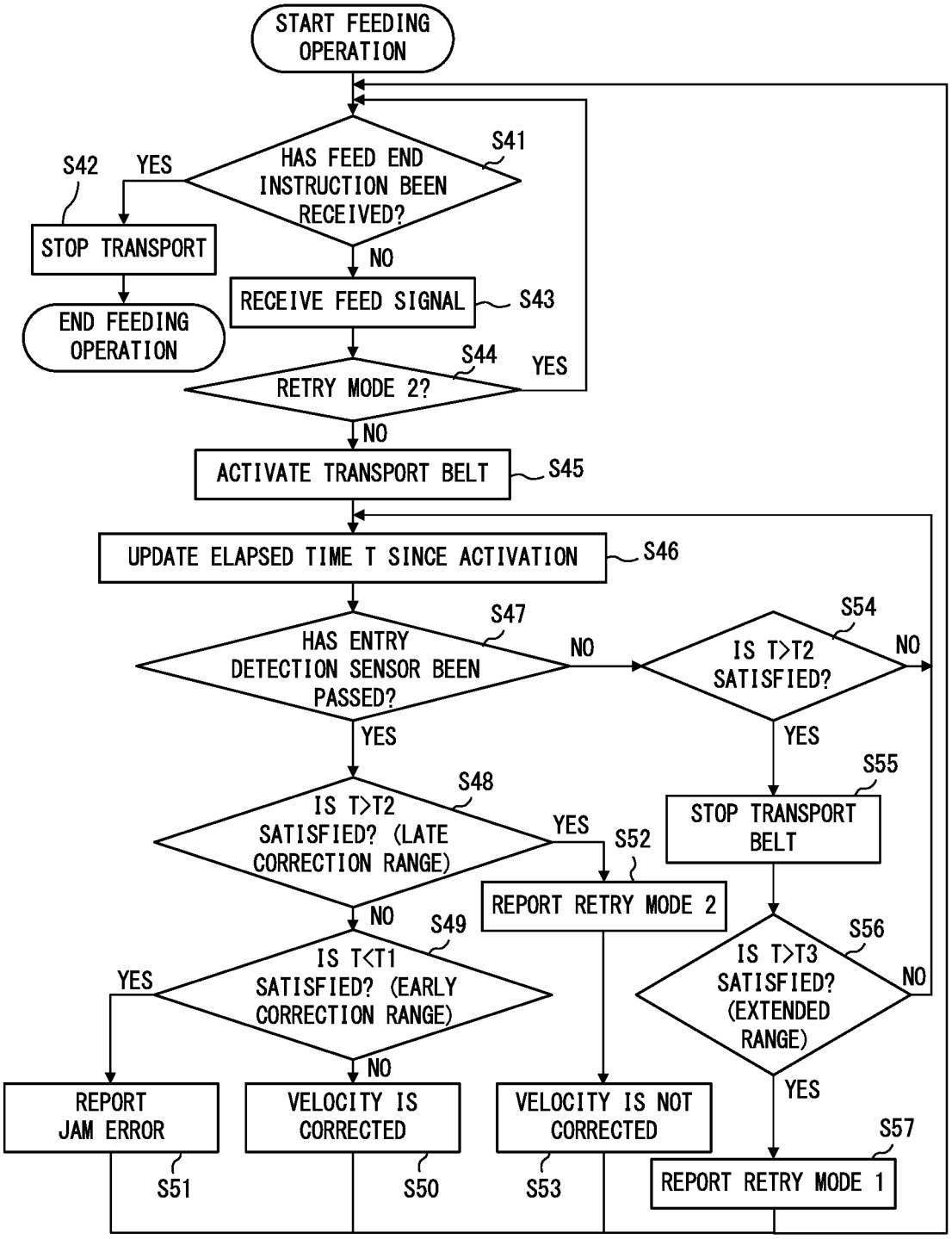
FIG. 4 is a flowchart for illustrating a medium feeding operation in one embodiment.

The following describes details of an operation of feeding media M in the present embodiment by referring to FIG. 4.

FIG. 4 is a flowchart for illustrating an operation of feeding media M.

For example, the processes of the flowchart indicated in FIG. 4 may start upon the controller 31 of the medium feeding apparatus 1 depicted in FIG. 2 receiving a feed signal for media M from the controller 151 of the printing apparatus 101.

The controller 31 of the medium feeding apparatus 1 determines whether a feed end instruction, which is sent from the controller 151 of the printing apparatus 101 in association with an end or suspension of printing, has been received (step S41).

When a feed end instruction is received (step S41: YES), the controller 31 causes the first feeder 11, the second feeder 12, and the first to ninth transport roller pairs 21-29 to stop transporting media M (step S42) and ends the feeding operation indicated in FIG. 4.

When a feed end instruction is not received (step S41: NO) but a feed signal is received (step S43), the controller 31 determines whether a medium M will be transported (taken in) in the retry mode 2 (described hereinafter) (step S44). When it is determined that a medium M will be transported in the retry mode 2 (step S44: YES), a new medium M will not be fed, so the controller 31 performs the processes again starting from step S41.

When determining that a medium M will not be transported in the retry mode 2 (step S44: NO), the controller 31 activates the transport belt 11*b* of the first feeder 11*b* or the transport belt 12*b* of the second feeder 12 (step S45; e.g., times t10 and t13 in FIG. 5).

The controller 31 updates an elapsed time T since the activation of the transport belt 11*b* or 12*b* (step S46) and determines whether a medium M has passed an entry detection sensor (first entrance passage detection sensor S11 or second entrance passage detection sensor S21) (step S47).

When a medium M has passed the entry detection sensor (step S47: YES; e.g., times t11 and t15 in FIG. 5), the controller 31 determines whether the elapsed time T has exceeded a time T2, i.e., the end of a correction range (step S48). In this example, the correction range, which is equal to or greater than T1 and is equal to or less than T2 ($T1 \leq T \leq T2$), is a first range R1 indicated in FIG. 5. The first range R1 and a second range R2 (described hereinafter) are not limited to the elapsed time T since the activation of the transport belt 11*b* or 12*b*, and may each be a time range that starts under another condition, e.g., a time range that starts at a time point at which the transport belt 11*b* or 12*b* reaches a predetermined rotation speed when the transport belt 11*b* or 12*b* is controlled to be activated.

When the elapsed time T is equal to or less than T2 (step S48: NO), the controller 31 determines whether the elapsed time T precedes the time T1, i.e., the beginning of the first range R1 (step S49).

When the controller 31 determines that the elapsed time T is equal to or greater than the time T1, i.e., the beginning of the first range R1 (step S49: NO), the first range R1 satisfies the relationship of $T1 \leq T \leq T2$ (e.g., time t11 in FIG. 5), so the controller 31 corrects the transport velocity of media M by controlling the first to fourth transport drives D1-D4 such that the arrival times at which the media M arrive at the paper-stop-roller pair 131 become more constant (step S50). The controller 151 of the printing apparatus 101 controls the paper-stop-roller pair 131 (a paper-stop drive for driving the paper-stop-roller pair 131) so as to take in a medium M at, for example, a time t12 in FIG. 5, i.e., a take-in time set in advance. The controller 31 of the medium feeding apparatus 1 performs the processes again starting from step S41.

Figure 8:
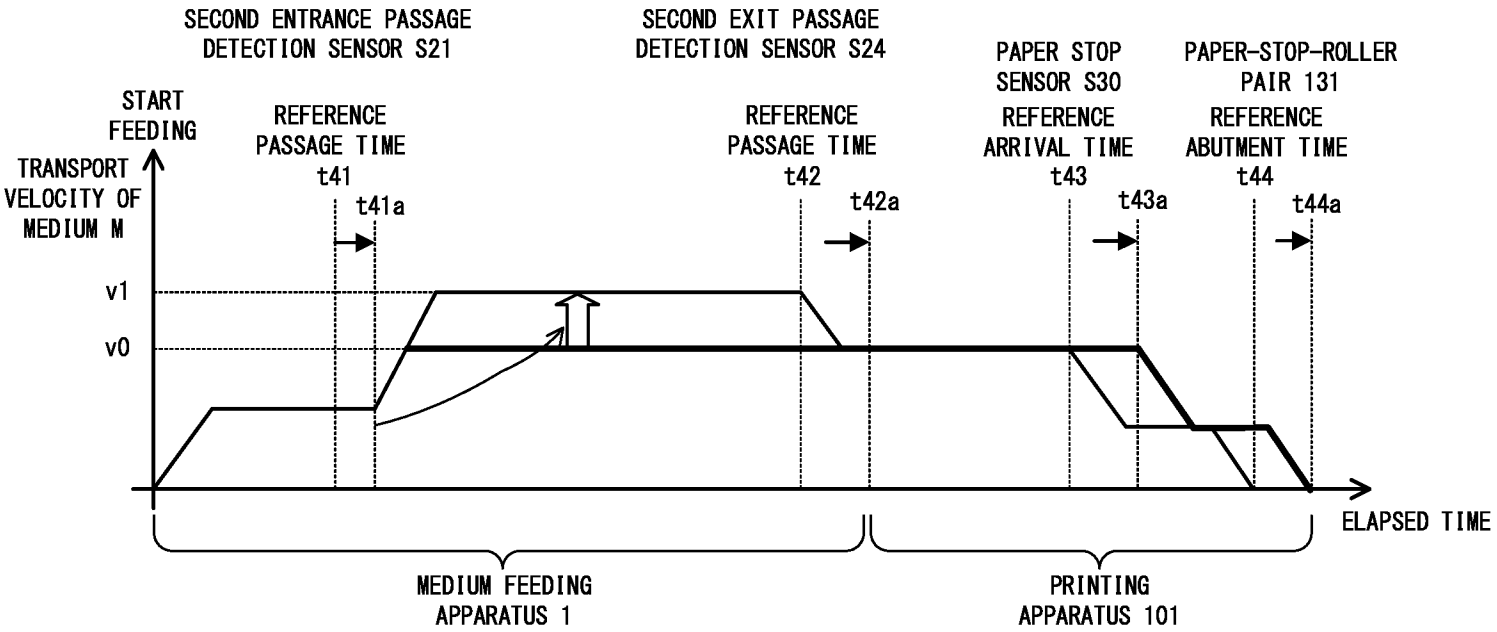
FIG. 8 depicts a relationship between a transport velocity and an elapsed time so as to illustrate a correction of the transport velocity in one embodiment (example 1)
Figure 9:
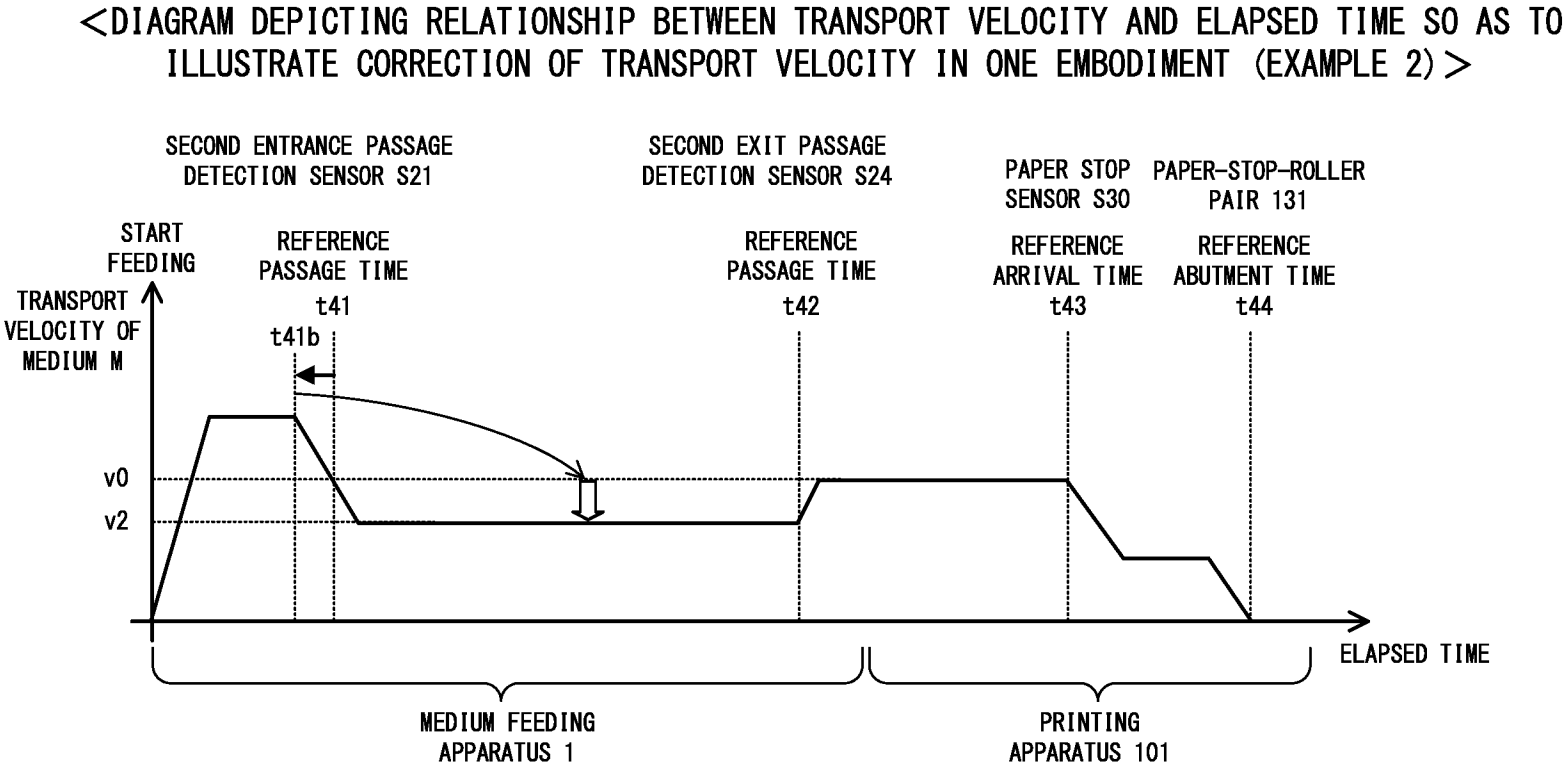
FIG. 9 depicts a relationship between a transport velocity and an elapsed time so as to illustrate a correction of the transport velocity in one embodiment (example 2)

The following describes a correction of the transport velocity of media M by referring to FIGS. 8 and 9.

FIGS. 8 and 9 depict a relationship between a transport velocity and an elapsed time so as to illustrate a correction of the transport velocity. With respect to FIGS. 8 and 9, descriptions are given of examples pertaining to media M fed from the second feeder 12.

In the example in FIG. 8, a passage timing (time t41*a*) at which a medium M passes the second entrance passage detection sensor S21 follows a reference passage time (time t41), which is a theoretical value determined in advance, due to a low transport rate resulting from strong slippage between the medium M and the transport belt 12*b*. Thus, in order to make up for the delay of the medium M and thus make more constant the abutment times (arrival times) at which media M abut the paper-stop-roller pair 131 (reference abutment time (reference arrival time)), the controller 31 determines, for the section between the second entrance passage detection sensor S21 and the second exit passage detection sensor S24 (the second individual transport path P2 and the joining transport path P3), a transport velocity v1 that is higher than a transport velocity v0 for the section between the second exit passage detection sensor S24 and the paper stop sensor S30. Note that the bold line in FIG. 8 indicates a situation in which the transport velocity is not corrected, as will be described hereinafter.

In the example in FIG. 9, a medium M and the transport belt 12*b* have weak slippage therebetween and thus the transport rate is high, with the result that the passage time at which the medium M passes the second entrance passage detection sensor S2 (time t41*b*) precedes the reference passage time (time t41), i.e., a theoretical value determined in advance. In this case, in order to make more constant the abutment times (arrival times) at which media M abut the paper-stop-roller pair 131 (reference abutment time (reference arrival time)), the controller 31 determines, for the section between the second entrance passage detection sensor S21 and the second exit passage detection sensor S24 (the second individual transport path P2 and the joining transport path P3), a transport velocity v2 that is lower than the transport velocity v0 for the section between the second exit passage detection sensor S24 and the paper stop sensor S30.

The deviation of the passage time at which a medium M passes the second entrance passage detection sensor S3 (time t41*a* or t41*b*) from the reference passage time (time t41) may occur not only when an uppermost medium M floated by floating air and then separated from a medium M thereunder by separation air is attraction-transported by the transport belt 12*b*, but also may occur due to friction between a handling plate and an upper most medium M when separating the uppermost medium M from a medium M thereunder by using the handling plate.

Referring to FIG. 4 again, when it is determined that the elapsed time T precedes the time T1 (step S49: YES), it can be said that a medium M has arrived at the entry detection sensor before the first range R1, so the controller 31 reports a jam error to the controller 151 of the printing apparatus 101 (step S51). Then, the controller 31 of the medium feeding apparatus 1 performs the processes again starting from step S41. For example, the controller 151 of the printing apparatus 101, upon receipt of a jam error report, may send a feed end instruction to the controller 31 so as to stop the feeding of media M.

Referring to step S48 again, it is determined that the elapsed time T has exceeded T2 (step S48: YES) only when it is determined that the elapsed time T is equal to or less than a time T3, i.e., the end of the second range R2, through steps S54-S56 (described hereinafter) before the medium M passages the entry detection sensor in step S47. Since the elapsed time falls within the second range R2, which satisfies the relationship of T2<T≤T3 (e.g., time t15 in FIG. 5), the controller 31 reports the retry mode 2 to the controller 151 of the printing apparatus 101 (step S52). In this case, the controller 31 does not correct the velocity of media M (step S53) and performs the processes again starting from step S41.

Figure 5:
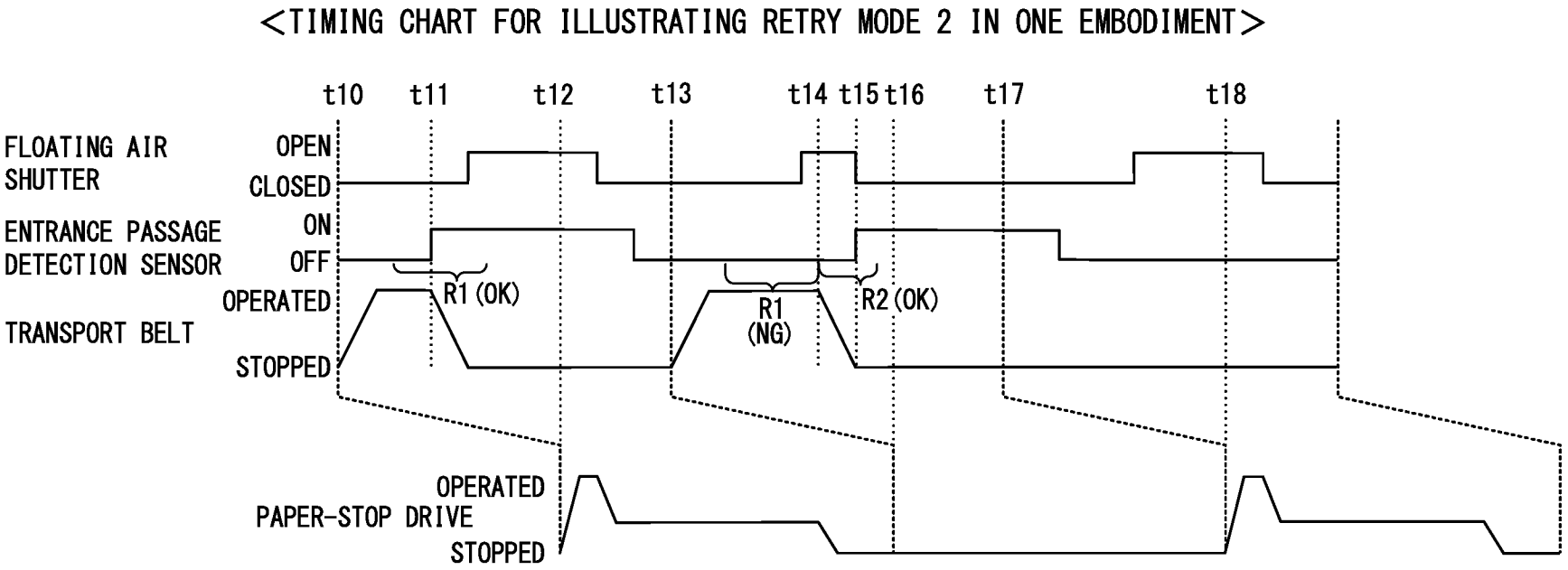
FIG. 5 is a timing chart for illustrating a retry mode 2 in one embodiment.
Figure 11:
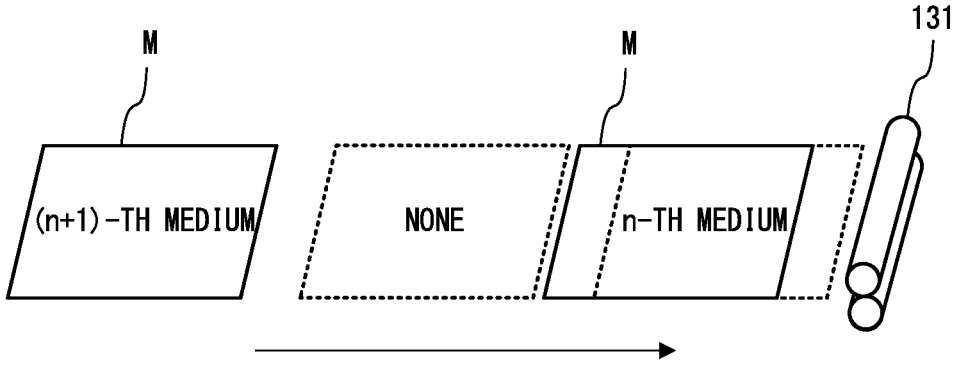
FIG. 11 illustrates a positional relationship between media during transport in one embodiment.

When the controller 31 of the medium feeding apparatus 1 reports the retry mode 2 to the controller 151 of the printing apparatus 101, the controller 31 delays the feeding of a medium M to be transported next from the feeder (e.g., one feeding operation is canceled as indicated by time t17 in FIG. 5). As a result, the transport velocity is not corrected (a correction for increasing the transport velocity is not made); and, as indicated by a thick solid line in FIG. 8, the medium M continues to be transported at the transport velocity v0, with a passage time t42*a* of arrival at the second exit passage detection sensor S24 following a reference passage time t42, an arrival time t43*a* of arrival at the paper stop sensor S30 following a reference arrival time t43, and an abutment time t44*a* (arrival time) of abutting the paper stop sensor 131 following a reference abutment time t44. However, as indicated in FIG. 11, a n-th medium M transported behind schedule (behind the schedule indicated by a dashed line) is not contacted by the next (n+1)-th medium M (medium M transported next) when the n-th medium M abuts the paper-stop-roller pair 131, because the feeding of the (n+1)-th medium M is delayed by, for example, one feeding operation as described above.

When the controller 31 of the medium feeding apparatus 1 reports the retry mode 2 to the controller 151 of the printing apparatus 101, the controller 151 of the printing apparatus 101 controls the paper-stop-roller pair 131 such that a take-in time for a medium M is delayed (e.g., cancel the take-in operation as indicated by time t16 in FIG. 5). For example, the controller 151 may control the paper-stop-roller pair 131 such that the medium M for which the take-in time has been delayed is taken in at a take-in time at which a medium M transported next was scheduled to be taken in (e.g., time 18 in FIG. 5).

Figure 10A:
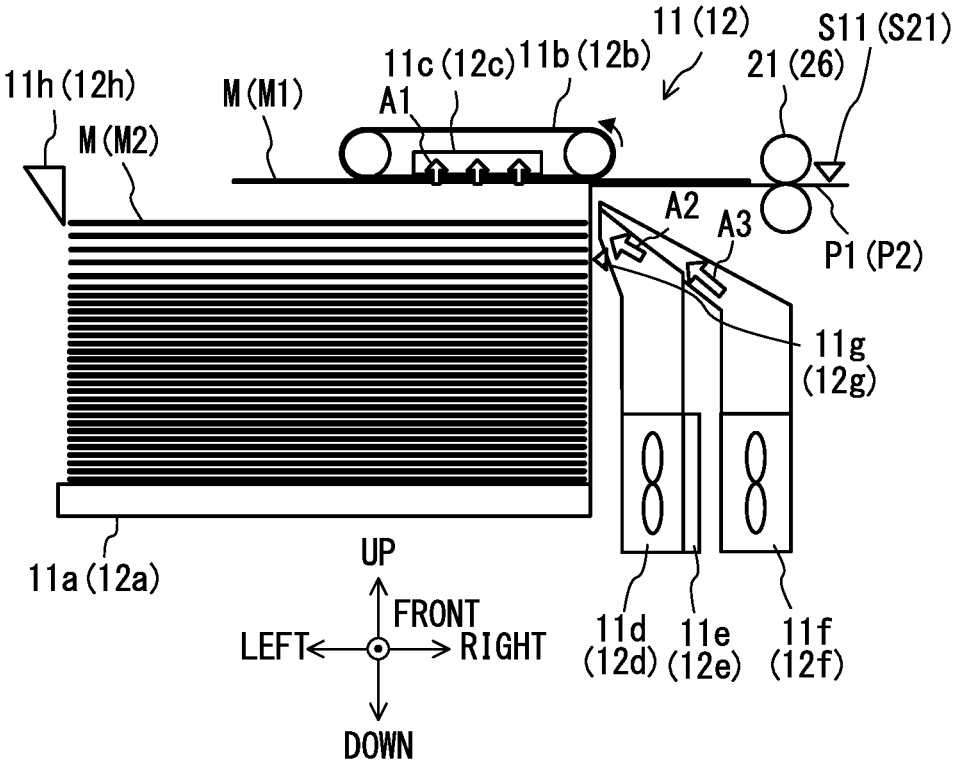
FIG. 10A depicts the internal configuration of a first feeder (second feeder) so as to illustrate the blocking of blowout of floating air in one embodiment (example 1)
Figure 10B:
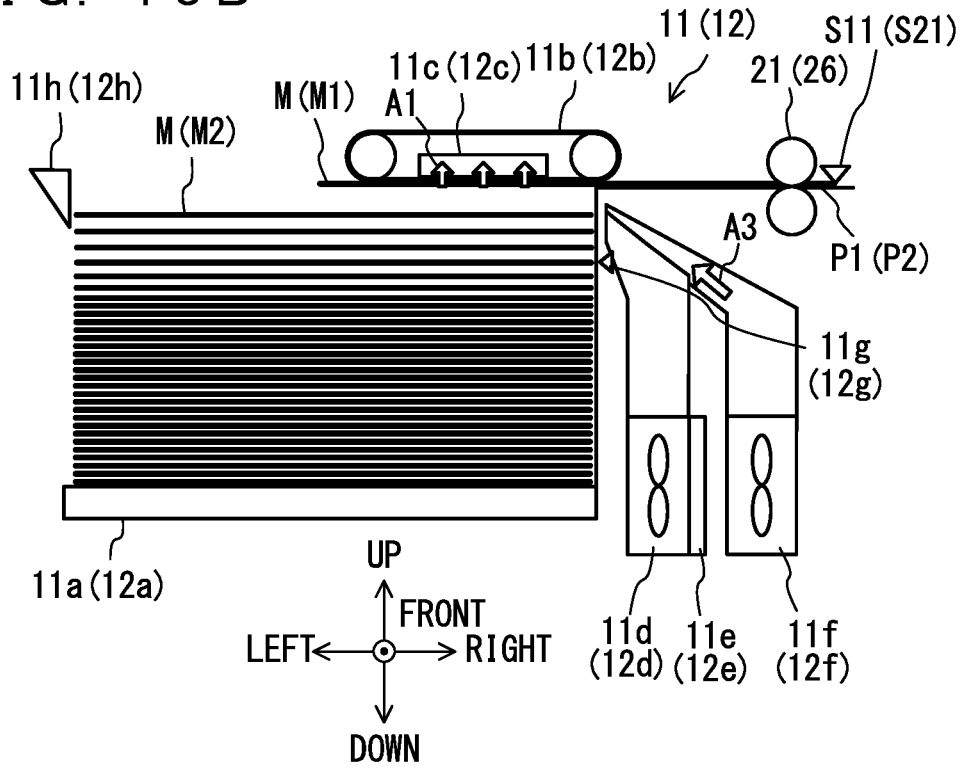
FIG. 10B depicts the internal configuration of a first feeder (second feeder) so as to illustrate the blocking of blowout of floating air in one embodiment (example 2)

When reporting the retry mode 2, the controller 31 may block the blowout of floating air A2 by means of the floating air shutter 11*e* or 12*e* depicted in FIG. 3 (e.g., time t15 in FIG. 5). In this way, a medium M that has been floating, as depicted in FIG. 10A, over the placement mount 11*a*(12*a*) by the floating-air blowout mechanism 11*d*(12*d*) blowing out floating air A2 falls because the blowout of floating air A2 is blocked as depicted in FIG. 10B when the entry detection sensor (first entrance passage detection sensor S11 or second entrance passage detection sensor S21) detects a preceding medium M. Hence, multi-feeding with overlapped printing on multiple sheets can be suppressed. In a case where, as depicted in FIG. 10B, the floating air shutter 11*e*(12*e*) has been closed and thus blowout of floating air A2 has been blocked, when reporting the retry mode 2, the controller 31 may keep the floating air shutter 11*e*(12*e*) closed until, for example, the next medium M is fed.

When reporting the retry mode 2, the controller 31 may reschedule permissible times for each sensor, as indicated in FIGS. 12A-12D. With respect to FIGS. 12A-12D, descriptions are given of examples pertaining to media M fed from the first feeder 11, with time measured in milliseconds.

As indicated in FIG. 12A, with respect to an elapsed time T since the activation of the transport belt 11*b*, the first entrance passage detection sensor S11 has a theoretical passage time of 100 and a permissible passage time of 80-120. For example, when the elapsed time T does not fall within the range of the permissible passage time, a nonarrival jam, i.e., an error indicating that a medium M has not been transported normally, may be reported to the controller 151. The first entrance passage detection sensor S11 has a permissible stagnation-jam time of 380. When the elapsed time T has exceeded the stagnation jam, the stagnation jam, which is an error indicating that a medium M has been stagnating in the transport route, is reported to the controller 151.

The first midstream passage detection sensor S12 (first midstream passage detection sensor 1), which has a required time (required time for transport) of 50 with reference to the first entrance passage detection sensor S11, has a theoretical passage time of 150, a permissible passage time of 135-165, and a permissible jam time of 435. The range of the permissible passage time of the first midstream passage detection sensor S12 is narrower than the range of the permissible passage time of the first entrance passage detection sensor S11 because the times of arrival at the paper-stop-roller pair 131 are made more constant when the transport velocity is corrected as described above.

The first midstream passage detection sensor S13 (first midstream passage detection sensor 2), which has a required time of 100 with reference to the first entrance passage detection sensor S11, has a theoretical passage time of 200, a permissible passage time of 190-210, and a permissible jam time of 490.

The first midstream passage detection sensor S14 (first midstream passage detection sensor 3), which has a required time of 150 with reference to the first entrance passage detection sensor S11, has a theoretical passage time of 250, a permissible passage time of 245-255, and a permissible jam time of 545.

The first exit passage detection sensor S15, which has a required time of 200 with reference to the first entrance passage detection sensor S11, has a theoretical passage time of 300, a permissible passage time of 300, and a permissible jam time of 600.

The paper stop sensor S30, which has a required time of 250 with reference to the first entrance passage detection sensor S11, has a theoretical passage time of 350, a permissible passage time of 350, and a permissible jam time of 650.

As indicated above, when the elapsed time T falls within the second range R2 that follows the first range R1 (permissible passage time), the actual passage time of the first entrance passage detection sensor S11 is a value exceeding the permissible passage time of 80-120 of the first entrance passage detection sensor S11, e.g., 140. Thus, the actual passage times of the other sensors are also expected to follow permissible passage times.

Accordingly, as indicated in FIG. 12B, for example, the controller 31 may set, as expected passage time for each sensor, the sum of the actual passage time of the first entrance passage detection sensor S11 (140) and the required time obtained with reference to the first entrance passage detection sensor S11.

As indicated in FIG. 12C, the controller 31 updates the end of the permissible passage time of each sensor to a time that follows an expected passage time. The controller 31 also voids permissible stagnation-jam times or changes the same to moderately long times.

When the take-in time for a medium M is settled (e.g., time t18 in FIG. 5), the controller 31 updates, as indicated in FIG. 12D, the permissible stagnation-jam times in accordance with the settled take-in time.

Referring again to the flowchart in FIG. 4, when a medium M does not pass the entry detection sensor (step S47: NO), the controller 31 determines, as in step S48, whether the elapsed time T has exceeded the time T2, i.e., the end of the first range R1 (step S54). When the elapsed time T is equal to or less than T2 (step S54: NO), the controller 31 returns to step S46.

When the elapsed time T has exceeded the time T2, i.e., the end of the first range R1 (step S54: YES), the controller 31 stops the transport belt 11*b*(12*b*) (step S55; e.g., time t14 in FIG. 5).

The controller 31 determines whether the elapsed time T has exceeded T3, i.e., the end of the second range R2 (extended range) (step S56). When the elapsed time T is equal to or less than T3 (step S56: NO), the controller 31 returns to step S46.

When the elapsed time T has exceeded T3 (step S56: YES; e.g., when the second range R2 that starts at time t24 in FIG. 6 is exceeded), the controller 31 reports the retry mode 1 to the controller 151 of the printing apparatus 101 (step S57) and performs the processes again starting from step S41.

Figure 6:
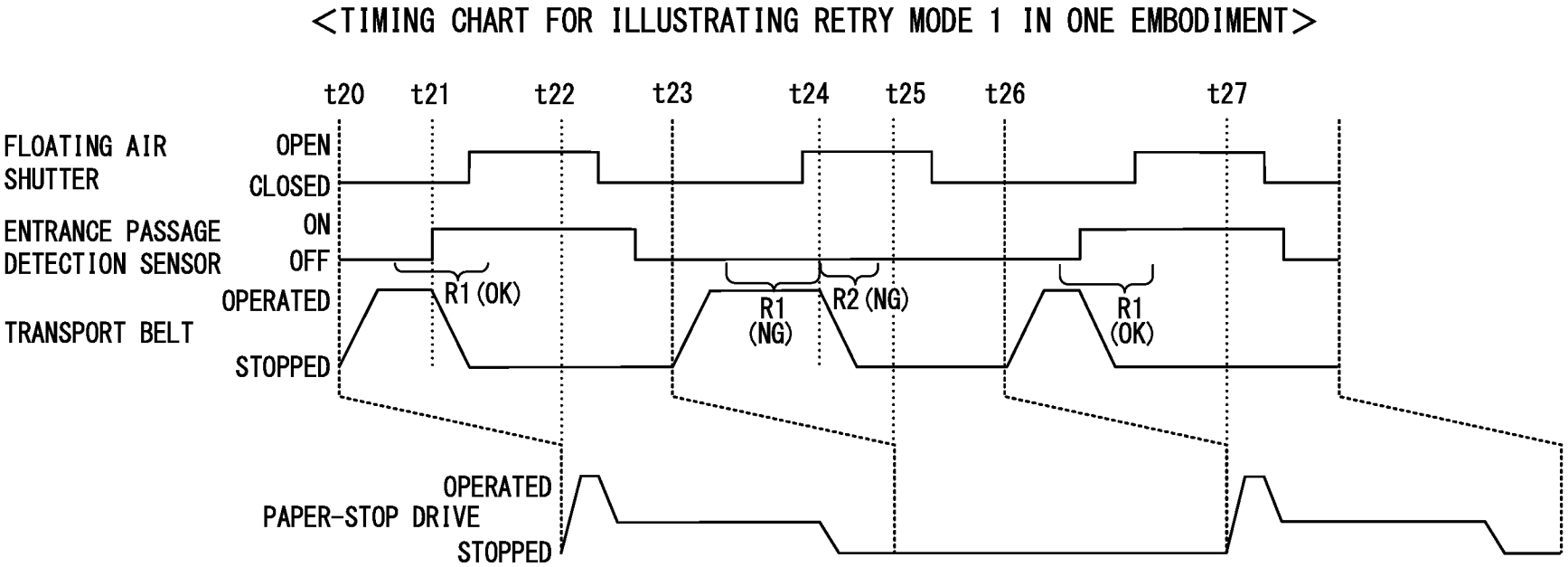
FIG. 6 is a timing chart for illustrating a retry mode 1 in one embodiment.

When the controller 31 of the medium feeding apparatus 1 reports the retry mode 1 to the controller 151 of the printing apparatus 101, the controller 151 controls the paper-stop-roller pair 131 so as to cancel the take-in operation for the medium M (e.g., time t25 in FIG. 6). Meanwhile, the controller 31 of the medium feeding apparatus 1 activates the transport belt 11*b*(12*b*) of the feeder (first feeder 11 or second feeder 12) so as to feed a next medium M normally (e.g., time t26 in FIG. 6, step S45 in FIG. 4). The controller 151 also controls the paper-stop-roller pair 131 so as to take in the next medium M at a take-in time set in advance (e.g., time 27 in FIG. 6).

In the described embodiment, the medium feeding mechanism includes: the feeder (e.g., first feeder 11, second feeder 12), i.e., an example of a feeder that feeds a medium M; the transport path (e.g., first individual transport path P1, second individual transport path P2, joining transport path P3) coupled to the feeder; the transporter (e.g., first to ninth transport roller pairs 21-29, reception roller pair 132), i.e., an example of a first conveyor that transports a medium M on the transport path; the transport drive (e.g., first to fourth transport drives D1-D4, the transport drive for the transporter 130) that drives the transporter; the entry detection sensor (e.g., first entrance passage detection sensor S11, second entrance passage detection sensor S12) that detects when a medium M fed from the feeder has entered the transport path; the take-in transporter (e.g., paper-stop-roller pair 131), i.e., an example of a second conveyor that takes in a medium M transported by the transporter; and the controller (e.g., controllers 31 and 151), i.e., an example of a transport controller that controls the feeder and the take-in transporter. When the entry detection sensor detects entry of a medium M at a time that falls within a first range R1 set in advance (e.g., time t11 in FIG. 5), the controller controls the take-in transporter so as to take in the medium M (e.g., time t12 in FIG. 5). When the entry detection sensor detects entry of a medium M at a time that falls within a second range R2 that follows the first range R1 (e.g., time t15 in FIG. 5), the controller controls the take-in transporter such that the take-in time for the medium M is delayed (e.g., set time t18 in place of time t16), and controls the feeder such that the feeding of a medium M to be transported next is delayed.

Figure 7:
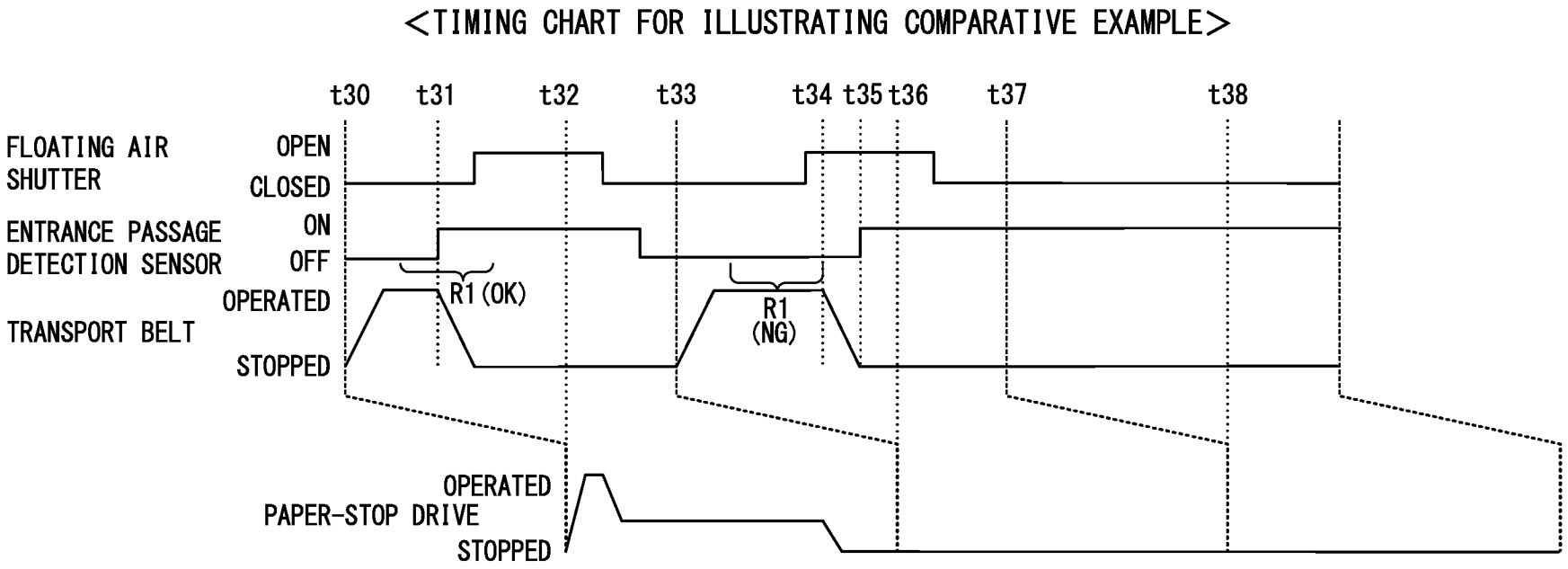
FIG. 7 is a timing chart for illustrating a comparative example.

In the meantime, when a medium M has not arrived at the entry detection sensor (entrance passage detection sensor) yet at a predetermined time (e.g., time t34, i.e., the end of the first range R1), even if the transport belt 11*b*(12*b*) is stopped as indicated in FIG. 7 (comparative example), the medium M may arrive at the entry detection sensor after the predetermined time (e.g., at time t35) because the transport belt 11*b*(12*b*) may not be capable of being stopped immediately. In this case, the feeding of the medium M is determined as being erroneous, so media M stop being fed, or the paper-stop-roller pair 31 (paper-stop drive) stops taking in a medium M (times t37 and t38). In the present embodiment, by contrast, when the entry detection sensor detects entry of a medium M at a time that falls within the second range R2 following the first range R1, the time at which the medium M is taken in by the take-in transporter and the feeding of a medium M to be transported next are delayed, and thus when the entry detection sensor detects a medium M at a time that follows a reference passage time, the medium M can be transported without the need to correct the transport velocity. Accordingly, complicated components such as a high-performance motor for increasing the transport velocity do not need to be provided, and an error, such as a jam that could occur when the transport of a medium M is delayed even after the transport velocity is increased, can be prevented from occurring.

Therefore, the present embodiment allows a medium M transported in a delayed fashion to be reliably transported with the simple configuration.

In the present embodiment, when the entry detection sensor detects entry of a medium M at a time that falls within the second range (e.g., time t15 in FIG. 5), the controller controls the take-in transporter such that the medium M, for which a take-in time (e.g., time t16) is delayed, is taken in at a take-in time at which a medium M to be transported next was scheduled to be taken in (e.g., time t18).

Thus, the medium M can be continuously transported by merely skipping one take-in action by the take-in transporter for the medium M (e.g., time t16 in FIG. 5). Hence, the medium M can be transported through the simple control.

In the present embodiment, when the entry detection sensor detects entry of a medium M at a time that falls within the first range R1, the controller corrects the transport velocity of media M by controlling the transport drive such that the media M arrive at the take-in transporter at more constant arrival times (e.g., transport velocity v1 in FIG. 8, transport velocity v2 in FIG. 9). When the entry detection sensor detects entry of a medium M at a time that falls within the second range R2, the controller does not make the correction of the transport velocity that is intended to make arrival times at which media M arrive at the take-in transporter more constant.

Accordingly, when the entry detection sensor detects a medium M at a time that falls within the first range R1, times at which media M arrive at the take-in transporter are made more constant, thereby, for example, preventing a time at which the printing unit 110 starts printing from being delayed and preventing the accuracy in correction of skew from varying. When the entry detection sensor detects a medium M at a time that falls within the second range R2, the controller delays a time at which the medium M is taken in by the take-in transporter (e.g., skip one take-in action), so that the medium M can be transported through the simple control in which the transport velocity is not corrected (correction for increasing the transport velocity is not made).

In the present embodiment, the medium feeding mechanism also includes the passage detection sensor that is positioned downstream from the entry detection sensor in the transport direction of a medium M and upstream from the take-in transporter in the transport direction and detects passage of the medium M (e.g., first midstream passage detection sensors S12-S14, first exit passage detection sensor S15, second midstream passage detection sensors S22 and S23, second exit passage detection sensor S24, paper stop sensor S30). When the entry detection sensor detects entry of a medium M at a time that falls within the second range R2, the controller reschedules the permissible times for detection of passage of a medium M by the passage detection sensor (e.g., the permissible passage times or permissible jam times in FIGS. 12A-12D).

Accordingly, when the transport velocity of a medium M fed in a delayed fashion and detected by the entry detection sensor at a time that falls within the second range R2 is not corrected, an error, such as a jam resulting from the delayed transport of the medium M, can be suppressed from occurring.

In the present embodiment, the feeder includes: the placement mount 11*a*(12*a*) on which media M are placed; the floating-air blowout mechanism 11*d*(12*d*) that blows out floating air A2 for floating at least an uppermost medium M1 among the plurality of media M placed on the placement mount 11*a*(12*a*); and the blocking part (e.g., the floating air shutters 11*e* and 12*e*) that blocks the blowout of floating air A2 by the floating-air blowout mechanism 11*d*(12*d*). When the entry detection sensor detects entry of a medium M at a time that falls within the second range R2, the controller causes the blocking part to block blowout of floating air A2 (e.g., time t15 in FIG. 5).

In this way, multi-feeding of media M, which could occur when a medium M to be transported next to a medium M that has been fed at a delayed time is floated by floating air A2, can be suppressed from occurring.

Another Embodiment

In the one embodiment described above, when the first entrance passage detection sensor S11 (second entrance passage detection sensor S21) (an example of an entry detection sensor) detects entry of a medium M at a time that falls within the second range R2 following the first range R1 (e.g., time t15 in FIG. 5), the controller 31 (151) controls the paper-stop-roller pair 131 such that the take-in time of the paper-stop-roller pair 131 (an example of a take-in transporter (second conveyor)) is delayed to, for example, a time at which a medium M to be transported next is scheduled to be taken in (e.g., time t18 is set in place of time t16).

Figure 13:
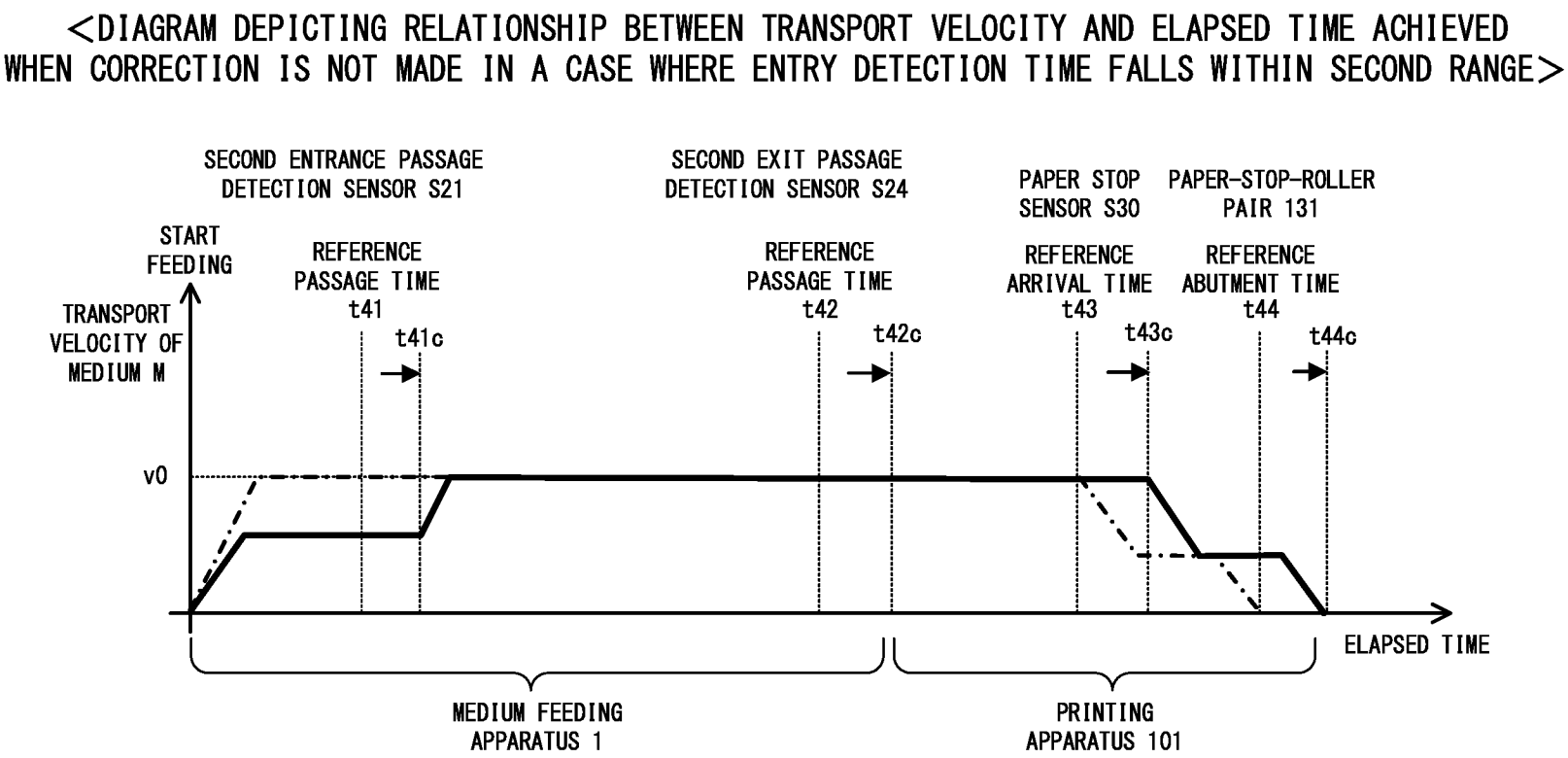
FIG. 13 illustrates a relationship between a transport velocity and an elapsed time achieved when a correction is not made in a case where an entry detection time falls within a second range.

For example, a correction for increasing the transport velocity will not be made for a medium M of which entry has been detected by the second entrance passage detection sensor S21 at a time that falls within the second range R2, although the medium M will be taken in by the paper-stop-roller pair 131 at a delayed time. Thus, the medium M is transported, as indicated in FIG. 13, at a prescribed transport velocity v0 indicated by a one-dot chain line that is equal to the transport velocity of a medium M transported normally. As a result, the medium M is transported such that the passage time t42*c* of passing the second exit passage detection sensor S24 follows the reference passage time t42, the arrival time t43*c* of arriving at the paper stop sensor S30 follows the reference arrival time t43, and the abutment time t44*c* (arrival time) of abutting the paper stop sensor 131 follows the reference abutment time t44.

However, when the abutment time t44*c* of abutting the paper-stop-roller pair 131 is delayed as described above, e.g., when the take-in time for the medium M is delayed to a time at which a medium M to be transported next is scheduled to be taken in, the medium M will continue to abut the paper-stop-roller pair 131 until the take-in time. Hence, the accuracy in correction of skew of the medium M will be reduced.

In the present embodiment, accordingly, when a time at which entry is detected falls within the second range R2, the transport drive (e.g., fourth transport drive D4) is controlled such that the transport of the medium M is temporarily stopped (or the transport velocity of the medium M is decreased) such that the medium M arrives at the paper-stop-roller pair 13 at a delayed time. The configuration of the printing system 100 in the present embodiment may be similar to that in the one embodiment described above, and the present embodiment is described herein only in terms of differences from the one embodiment described above.

Figure 14:
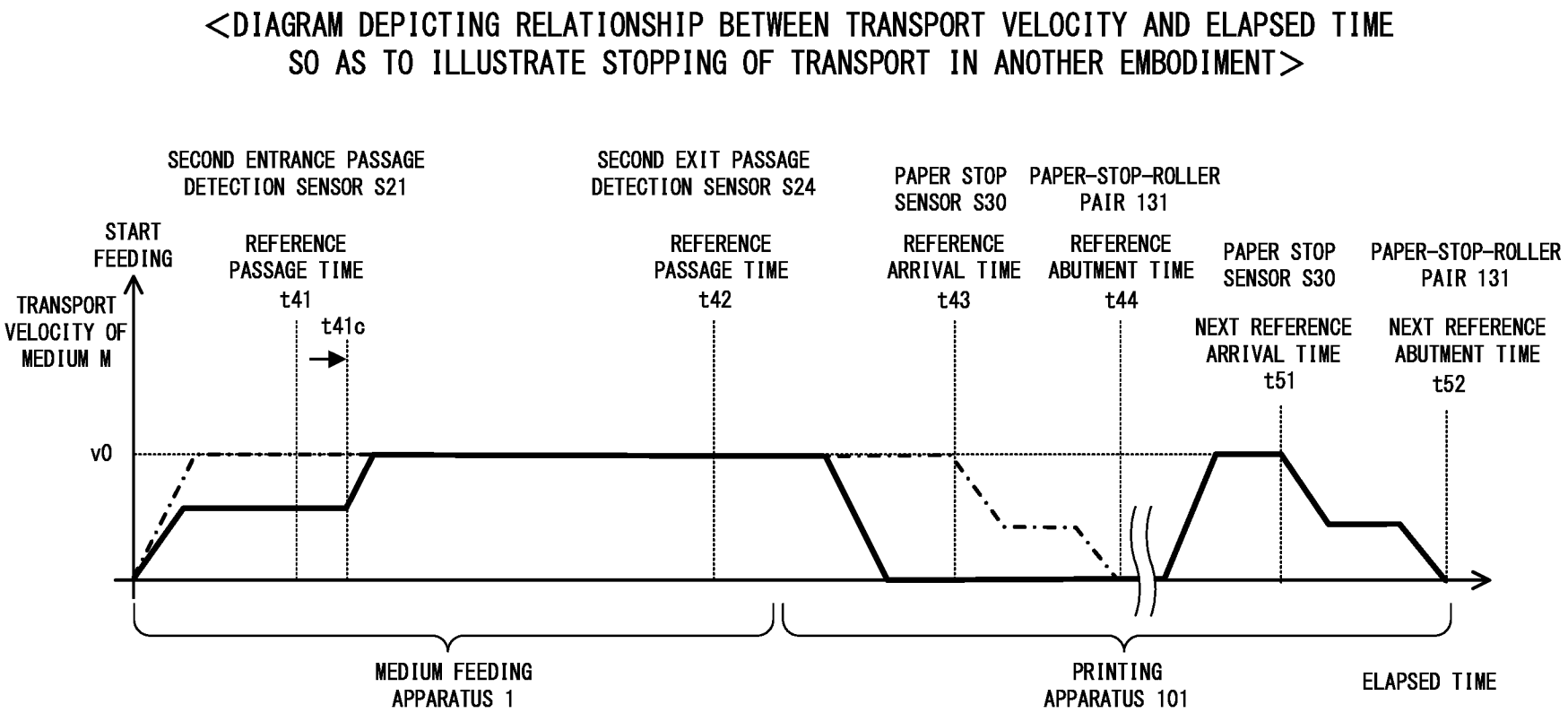
FIG. 14 depicts a relationship between a transport velocity and an elapsed time so as to illustrate the stopping of transport in another embodiment.

FIG. 14 depicts a relationship between a transport velocity and an elapsed time so as to illustrate the stopping of transport. With respect to FIG. 14, descriptions are given of examples pertaining to media M fed from the second feeder 12, as in the case of FIG. 13.

When a medium M and the transport belt 12*b* have strong slippage therebetween and thus the transport rate is low and the medium M passes the second entrance passage detection sensor S21 at a passage time (time t41*c*) that falls within the second range R2 (e.g., time t15 in FIG. 5), the passage time (time t41*c*) follows the reference passage time (time t41), i.e., a theoretical value determined in advance.

After the medium M passes the second entrance passage detection sensor S21, the controller 31 controls the third transport drive D3 such that the transport velocity of the medium M increases to the transport velocity v0, as with the transport velocity of a medium M transported normally that is indicated by the one-dot chain line. The controller 31 temporarily stops the transport of the medium M while the leading edge of the medium M is situated between the second exit passage detection sensor S24 and the paper-stop-roller pair 131.

Before the medium M arrives at the paper-stop-roller pair 131, the controller 31 controls the fourth transport drive D4 such that the transport velocity of the medium M returns to the prescribed transport velocity v0. The timing at which the transport velocity of a medium M that was stopped by the controller 31 returns to the transport velocity v0 like this may be adjusted by controlling the fourth transport drive D4 and the transport drive for the transporter 130 such that the medium M arrives at the paper-stop-roller pair 131 at an arrival time at which a medium M to be transported next was scheduled to arrive at the paper-stop-roller pair 131 (reference abutment time t52). In this case, the medium M arrives at the paper stop sensor S30 at the time that is the same as the arrival time at which the medium M to be transported next was scheduled to arrive at the paper stop sensor S30 (reference arrival time t51). However, when the medium M arrives at the paper stop sensor S30 before the arrival time at which the medium M to be transported next was scheduled to arrive at the paper stop sensor S30 (reference arrival time t51), the transport of the medium M may be temporarily stopped or the transport velocity of the medium M may be decreased, so as to shorten, to some degree, the period of time during which the medium M abuts the paper-stop-roller pair 131.

In the example depicted in FIG. 14, the transport of the medium M is temporarily stopped. However, the period of time during which the medium M abuts the paper-stop-roller pair 131 may also be shortened by decreasing the transport velocity of the medium M to such a degree that the transport velocity does not decrease to 0.

In the present embodiment, the transport of the medium M may be temporarily stopped such that the medium M arrives at the paper-stop-roller pair 131 at a delayed time. This may be attained by performing temporal rescheduling such that the expected passage time and the end of the permissible passage time in the table in FIG. 12D for rescheduling the permissible times for the sensors (which are respectively 390 msec and 395 msec) are delayed to the expected passage time and the end of the permissible passage time in FIG. 15 (which are respectively 705 msec and 710 msec).

In the meantime, the reception roller pair 132 depicted in FIG. 1 nips a medium M that is relatively short in the transport direction but does not nip a medium M that is relatively long in the transport direction. This is intended to decrease the influence of the difference between the transport velocity attained by the first to fourth transport drives D1-D4 on the medium-feeding-apparatus-1 side and the transport velocity attained by the transport drives on the printing-apparatus-10 side because a long medium M can be transported by the eighth transport roller pair 28, the ninth transport roller pair 29, and the paper-stop-roller pair 131. Accordingly, when a long medium M is stopped or decelerated as described above, the leading edge thereof may be positioned between the reception roller pair 132 and the paper-stop-roller pair 131; and when a short medium M is stopped or decelerated as described above, the leading edge thereof may be positioned upstream from the reception roller pair 132, and more desirably, the leading edge of the short medium M passes the reception roller pair 132 after being accelerated again (after returning to the transport velocity v0). Meanwhile, when a medium M is stopped or decelerated as described above, control may be simply performed by the fourth transport drive D4 alone without using the second transport drive D2 and the third transport drive D3 (in particular, the second transport drive D2 disposed within the upper stage 1*a* of the medium feeding apparatus 1, unlike the fourth transport drive D4).

The other embodiment described so far can exhibit similar effects to the one embodiment in terms of similar matters, i.e., can exhibit the effect wherein a medium M fed in a delayed fashion can be reliably transported by means of the simple configuration.

In the present embodiment, when the entry detection sensor (e.g., first entry detection sensor S11, second entry detection sensor S21) detects entry of a medium M at a time that falls within the second range R2, the controller (e.g., controller 31 or 151) controls the transport drive (e.g., fourth transport drive D4) such that the transport of the medium M is temporarily stopped or the transport velocity of the medium M is decreased, such that the medium M arrives at the take-in transporter (e.g., paper-stop-roller pair 131) at a delayed time.

Accordingly, a medium M for which the take-in time has been delayed as described above due to the entry detection time falling within the second range R2 (e.g., time t18 is set in place of time t16 in FIG. 5) can be suppressed from abutting the take-in transporter for a long time.

In the present embodiment, after temporarily stopping the transport of a medium M or decreasing the transport velocity of the medium M, the controller controls the transport drive such that the transport velocity of the medium M returns to the prescribed transport velocity v0 before the medium M arrives at the take-in transporter.

In this way, for the medium M for which the transport is temporarily stopped or the transport velocity is decreased, the transport control immediately before arrival at the take-in transporter can be performed, as in the case of a normally transported medium M for which the transport is not temporarily stopped and the transport velocity is not decreased. Hence, skew of the medium M for which the transport is temporarily stopped or the transport velocity is decreased can be corrected by performing control similar to the control for the normally transported medium M.

In the present embodiment, after temporarily stopping the transport of a medium M or decreasing the transport velocity of the medium M, the controller controls the transport drive such that the medium M arrives at the take-in transporter at an arrival time at which a medium M to be transported next was scheduled to arrive at the take-in transporter (e.g., reference abutment time 52 in FIG. 14).

In this way, the medium M can be taken in by the take-in transporter soon, so that the medium M can be prevented from abutting the take-in transporter for a long time.

The present invention is not simply limited to the embodiments described herein. Components of the embodiments may be embodied in a varied manner in an implementation phase without departing from the gist of the invention. A plurality of components disclosed with reference to the described embodiments may be combined, as appropriate, to achieve various inventions. For example, all of the components indicated with reference to embodiments may be combined as appropriate. Accordingly, various variations and applications can be provided, as a matter of course, without departing from the gist of the invention. The following indicates, as appendixes, the invention set forth in the claims of the corresponding Japanese application as originally filed.

In one aspect, the present application pertains to the following.

A medium feeding mechanism comprising:

a feeder that feeds a medium;

a transport path that is coupled to the feeder;

a transporter that transports the medium through the transport path;

a transport drive that drives the transporter;

an entry detection sensor that detects when the medium fed from the feeder has entered the transport path;

a take-in transporter that takes in the medium transported by the transporter; and a controller that controls the feeder and the take-in transporter, wherein when the entry detection sensor detects entry of the medium at a time that falls within a first range set in advance, the controller controls the take-in transporter so as to take in the medium, and when the entry detection sensor detects entry of the medium at a time that falls within a second range following the first range, the controller controls the feeder so as to delay feeding of a medium to be transported next, and controls the take-in transporter so as to delay a take-in time for the medium.

In another aspect, when the entry detection sensor detects entry of the medium at a time that falls within the second range, the controller controls the take-in transporter such that the medium for which the take-in time has been delayed is taken in at a take-in time at which the medium to be transported next was scheduled to be taken in.

In another aspect, when the entry detection sensor detects entry of the medium at a time that falls within the first range, the controller corrects a transport velocity of the medium by controlling the transport drive such that media arrive at the take-in transporter at more constant arrival times, and when the entry detection sensor detects entry of the medium at a time that falls within the second range, the controller does not make the correction of the transport velocity that is intended to make arrival times at which media arrive at the take-in transporter more constant.

In another aspect, the medium feeding mechanism further comprises a passage detection sensor that is positioned downstream from the entry detection sensor in a transport direction of the medium and upstream from the take-in transporter in the transport direction and detects passage of the medium, and when the entry detection sensor detects entry of the medium at a time that falls within the second range, the controller reschedules a permissible time for detection of passage of the medium by the passage detection sensor.

In another aspect, the feeder includes a placement mount on which media are placed, a floating-air blowout mechanism that blows out floating air for floating at least an uppermost medium among the plurality of media placed on the placement mount, and a blocking part that blocks the blowout of the floating air by the floating-air blowout mechanism, and when the entry detection sensor detects entry of the medium at a time that falls within the second range, the controller causes the blocking part to block the blowout of the floating air.

In another aspect, when the entry detection sensor detects entry of the medium at a time that falls within the second range, the controller controls the transport drive such that the transport of the medium is temporarily stopped or a transport velocity of the medium is decreased, so as to cause the medium to arrive at the take-in transporter at a delayed time.

In another aspect, after temporarily stopping the transport of the medium or decreasing the transport velocity of the medium, the controller controls the transport drive such that the transport velocity of the medium returns to a prescribed transport velocity before the medium arrives at the take-in transporter.

In another aspect, after temporarily stopping the transport of the medium or decreasing the transport velocity of the medium, the controller controls the transport drive such that the medium arrives at the take-in transporter at an arrival time at which the medium to be transported next was scheduled to arrive at the take-in transporter.

What is claimed is:

1. A medium feeding mechanism comprising:

a feeder that feeds a medium;

a transport path that is coupled to the feeder;

a transporter that transports the medium through the transport path;

a transport drive that drives the transporter;

an entry detection sensor that detects when the medium fed from the feeder has entered the transport path;

a take-in transporter that takes in the medium transported by the transporter; and a transport controller that controls the feeder and a destination controller that controls the take-in transporter, wherein when the entry detection sensor detects entry of the medium at a time that falls within a first range set in advance, the destination controller controls the take-in transporter so as to take in the medium, when the entry detection sensor detects entry of the medium at a time that falls within a second range following the first range, the transport controller controls the feeder so as to delay feeding of a medium to be transported next, and the transport controller is configured to communicate with the destination controller to instruct the destination controller to control the take-in transporter so as to delay a take-in time for the medium, and when the entry detection sensor detects entry of the medium at a time that falls within the second range, the transport controller is configured to communicate with the destination controller to instruct the destination controller to control the take-in transporter such that the medium for which the take-in time has been delayed is taken in at a take-in time at which the medium to be transported next was scheduled to be taken in.

2. The medium feeding mechanism of claim 1, wherein when the entry detection sensor detects entry of the medium at a time that falls within the first range, the transport controller corrects a transport velocity of the medium by controlling the transport drive such that media arrive at the take-in transporter at more constant arrival times, and when the entry detection sensor detects entry of the medium at a time that falls within the second range, the transport controller does not make the correction of the transport velocity that is intended to make arrival times at which media arrive at the take-in transporter more constant.

3. The medium feeding mechanism of claim 1, further comprising:

a passage detection sensor that is positioned downstream from the entry detection sensor in a transport direction of the medium and upstream from the take-in transporter in the transport direction and detects passage of the medium, wherein when the entry detection sensor detects entry of the medium at a time that falls within the second range, the transport controller reschedules a permissible time for detection of passage of the medium by the passage detection sensor.

4. The medium feeding mechanism of claim 1, wherein the feeder includes a placement mount on which media are placed, a floating-air blowout mechanism, including at least a fan, configured to blow out floating air for floating at least an uppermost medium among the plurality of media placed on the placement mount, and a blocking part, including at least a shutter, configured to block the blowout of the floating air by the floating-air blowout mechanism, and when the entry detection sensor detects entry of the medium at a time that falls within the second range, the transport controller causes the blocking part to block the blowout of the floating air.

5. The medium feeding mechanism of claim 1, wherein when the entry detection sensor detects entry of the medium at a time that falls within the second range, the transport controller controls the transport drive such that the transport of the medium is temporarily stopped or a transport velocity of the medium is decreased, so as to cause the medium to arrive at the take-in transporter at a delayed time.

6. The medium feeding mechanism of claim 5, wherein after temporarily stopping the transport of the medium or decreasing the transport velocity of the medium, the transport controller controls the transport drive such that the transport velocity of the medium returns to a prescribed transport velocity before the medium arrives at the take-in transporter.

7. The medium feeding mechanism of claim 5, wherein after temporarily stopping the transport of the medium or decreasing the transport velocity of the medium, the transport controller controls the transport drive such that the medium arrives at the take-in transporter at an arrival time at which the medium to be transported next was scheduled to arrive at the take-in transporter.

8. A medium feeding mechanism comprising:

a feeder that feeds a medium;

a transport path that is coupled to the feeder;

a transporter that transports the medium through the transport path;

a transport drive that drives the transporter;

an entry detection sensor that detects when the medium fed from the feeder has entered the transport path;

a take-in transporter that takes in the medium transported by the transporter; and a transport controller that controls the feeder and a destination controller that controls the take-in transporter, wherein when the entry detection sensor detects entry of the medium at a time that falls within a first range set in advance, the destination controller controls the take-in transporter so as to take in the medium, when the entry detection sensor detects entry of the medium at a time that falls within a second range following the first range, the transport controller controls the feeder so as to delay feeding of a medium to be transported next, and the transport controller is configured to communicate with the destination controller to instruct the destination controller to control the take-in transporter so as to delay a take-in time for the medium, when the entry detection sensor detects entry of the medium at a time that falls within the first range, the transport controller corrects a transport velocity of the medium by controlling the transport drive such that media arrive at the take-in transporter at more constant arrival times, and when the entry detection sensor detects entry of the medium at a time that falls within the second range, the transport controller does not make the correction of the transport velocity that is intended to make arrival times at which media arrive at the take-in transporter more constant.

9. A medium feeding mechanism comprising:

a feeder that feeds a medium;

a transport path that is coupled to the feeder;

a transporter that transports the medium through the transport path;

a transport drive that drives the transporter;

an entry detection sensor that detects when the medium fed from the feeder has entered the transport path;

a take-in transporter that takes in the medium transported by the transporter; and a transport controller that controls the feeder and a destination controller that controls the take-in transporter, wherein when the entry detection sensor detects entry of the medium at a time that falls within a first range set in advance, the destination controller controls the take-in transporter so as to take in the medium, when the entry detection sensor detects entry of the medium at a time that falls within a second range following the first range, the transport controller controls the feeder so as to delay feeding of a medium to be transported next, and the transport controller is configured to communicate with the destination controller to instruct the destination controller to control the take-in transporter so as to delay a take-in time for the medium, the feeder includes a placement mount on which media are placed, a floating-air blowout mechanism, including at least a fan, is configured to blow out floating air for floating at least an uppermost medium among the plurality of media placed on the placement mount, and a blocking part, including at least a shutter, configured to block the blowout of the floating air by the floating-air blowout mechanism, and when the entry detection sensor detects entry of the medium at a time that falls within the second range, the transport controller causes the blocking part to block the blowout of the floating air.

* * * * *